US010460548B2

(12) United States Patent
Takeuchi

(10) Patent No.: US 10,460,548 B2
(45) Date of Patent: Oct. 29, 2019

(54) ARTICLE DISPENSING APPARATUS

(71) Applicant: FUJI ELECTRIC CO., LTD., Kawasaki-shi, Kanagawa (JP)

(72) Inventor: Shirou Takeuchi, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/601,514

(22) Filed: May 22, 2017

(65) Prior Publication Data

US 2017/0263070 A1 Sep. 14, 2017

Related U.S. Application Data

(63) Continuation of application No. PCT/JP2015/081613, filed on Nov. 10, 2015.

(30) Foreign Application Priority Data

Nov. 28, 2014 (JP) ..... 2014-242200

(51) Int. Cl.
*G07F 11/24* (2006.01)
*G07F 11/34* (2006.01)
(Continued)

(52) U.S. Cl.
CPC ..... *G07F 11/24* (2013.01); *G07F 11/08* (2013.01); *G07F 11/34* (2013.01); *G07F 11/42* (2013.01);
(Continued)

(58) Field of Classification Search
CPC ..... G07F 11/005; G07F 11/08; G07F 11/16; G07F 11/24; G07F 11/34; G07F 11/38; G07F 11/42; G07F 11/54; G07F 11/56
See application file for complete search history.

(56) References Cited

U.S. PATENT DOCUMENTS 4,423,828 A * 1/1984 Tanaka ..... G07F 11/10 221/129
5,445,296 A * 8/1995 Insausti ..... B65G 59/062 221/298
(Continued)

FOREIGN PATENT DOCUMENTS

CN 1146819 A 4/1997
CN 1523542 A 8/2004
(Continued)

OTHER PUBLICATIONS

PCT/JP2015/081613 "International Search Report" dated Dec. 8, 2015.
(Continued)

*Primary Examiner* — Gene O Crawford
*Assistant Examiner* — Kelvin L Randall, Jr.
(74) *Attorney, Agent, or Firm* — Manabu Kanesaka

(57) ABSTRACT

An article dispensing apparatus includes: one article discharging apparatus; and another article discharging apparatus, the one article discharging apparatus and the other article discharging apparatus being capable of being combined in a back-to-back manner. The one article discharging apparatus includes: a driving source; an output gear configured to rotate by a driving force from the driving source when a discharging instruction has been given to the one article discharging apparatus; link levers where each link lever is provided rotatably about an axis of the link lever; and a controller configured to, when the output gear is rotated from the standby position by the discharging instruction, prohibit stopping of drive of the driving source to allow the rotation of the output gear until a preset prohibited time elapses from starting of the rotation of the output gear even when supply of electric power to the driving source is interrupted.

8 Claims, 30 Drawing Sheets

(51) Int. Cl.

| | |
|---|---|
| ***G07F 11/42*** | (2006.01) |
| ***G07F 11/56*** | (2006.01) |
| ***G07F 11/08*** | (2006.01) |
| *G07F 11/16* | (2006.01) |
| *G07F 11/38* | (2006.01) |
| *G07F 11/54* | (2006.01) |

(52) U.S. Cl.
CPC ..... *G07F 11/56* (2013.01); *G07F 11/16* (2013.01); *G07F 11/38* (2013.01); *G07F 11/54* (2013.01)

(56) References Cited

U.S. PATENT DOCUMENTS 5,799,823 A * 9/1998 Feltrin ..... G07F 11/08 221/242
6,135,337 A * 10/2000 Harris ..... B25C 5/0228 227/131
6,467,648 B1 * 10/2002 Nishiyama ..... G07F 11/06 221/289
9,741,196 B2 8/2017 Yamagami et al.

FOREIGN PATENT DOCUMENTS

| | | | | |
|---|---|---|---|---|
| CN | 1525416 | A | | 9/2004 |
| CN | 102682526 | A | | 9/2012 |
| CN | 102737446 | A | | 10/2012 |
| CN | 103930933 | A | | 7/2014 |
| JP | 2749917 | B2 | | 2/1998 |
| JP | 2001188955 | A | * | 7/2001 |
| JP | 2002-230635 | A | | 8/2002 |
| JP | 2009-230635 | A | | 8/2002 |
| JP | 2002-358565 | A | | 12/2002 |

OTHER PUBLICATIONS

China Patent Office, Office Action for Chinese Patent Application No. 201580064058.5, dated Nov. 26, 2018.

* cited by examiner

ARTICLE DISPENSING APPARATUS

CROSS REFERENCES TO RELATED APPLICATIONS

This application is a continuation of PCT international application Ser. No. PCT/JP2015/081613 filed on Nov. 10, 2015 which designates the United States, incorporated herein by reference, and which claims the benefit of priority from Japanese Patent Applications No. 2014-242200, filed on Nov. 28, 2014, incorporated herein by reference.

BACKGROUND

1. Technical Field

The disclosure relates to an article dispensing apparatus, and more specifically, to an article dispensing apparatus that is used for vending machines that sell articles such as canned beverages and PET-bottled beverages and discharges articles stored in article storage passages as appropriate.

2. Related Art

In vending machines that sell articles such as canned beverages and PET-bottled beverages, an article storage rack has been conventionally provided in an article storage inside a main body cabinet as a vending machine main body. The article storage rack has article storage passages extending in an up-and-down direction and article discharging apparatuses arranged at the lower part of the article storage passages.

The article discharging apparatus includes a lower pedal and an upper pedal. The lower pedal and the upper pedal are linked with an AC solenoid as an actuator via links and advance and retract to and from the article storage passage as appropriate through the energization of the AC solenoid.

In such an article discharging apparatus, in a standby state, the upper pedal is retracted from the article storage passage, whereas the lower pedal is advanced to the article storage passage. With this configuration, the lower pedal comes into contact with the lowermost article stored in the article storage passage, thereby preventing articles stored in the article storage passage from moving downward.

When a discharging instruction for an article is given, in the article discharging apparatus at the lower part of the article storage passage that stores therein a corresponding article, the AC solenoid is energized, whereby the upper pedal advances to the article storage passage via the link to come into contact with the second lowermost article, thereby preventing the article and articles stored above the article from moving downward. In addition, the AC solenoid is energized, whereby the lower pedal retracts from the article storage passage, only the lowermost article is discharged downward, and when the article slips through the lower pedal, the lower pedal advances to the article storage passage by the biasing force of a spring. After that, when the energized state of the AC solenoid is released to be a non-energized state, the lower pedal that has advanced to the article storage passage is prevented from retracting, and the upper pedal has retracted from the article storage passage, thereby returning to the standby state.

In the article storage rack, two article storage passages are generally adjacent to each other fore and aft, and the article discharging apparatuses to be used for the respective article storage passages are arranged at the article storage passages combined in a back-to-back manner. This article discharging apparatus requires an AC solenoid as a driving source for each of the combined article discharging apparatuses.

Given these circumstances, to reduce manufacturing costs by reducing the number of driving sources, described is an article dispensing apparatus that combines article discharging apparatuses with the AC solenoid removed in a back-to-back manner, includes a driving source and a cam therebetween, and drives the respective article discharging apparatuses by the drive of the driving source and the rotation of the cam (refer to Japanese Patent No. 2749917, for example).

SUMMARY

However, the article dispensing apparatus described in Japanese Patent No. 2749917 combines the article discharging apparatuses with the AC solenoid removed in a back-to-back manner and includes the driving source and the cam therebetween, and it has been difficult to separate the two article discharging apparatuses combined in a back-to-back manner as components and to use only either one of them, although the number of driving sources can be reduced relative to the number of the article discharging apparatuses. In other words, in the article dispensing apparatus described in Japanese Patent No. 2749917, although the article discharging apparatus can be used for an article storage rack including an even number of article storage passages adjacent to each other fore and aft, the article discharging apparatus has not been able to be used for an article storage rack including an odd number of article storage passages as an individual article discharging apparatus. In addition, it is general for the article dispensing apparatus to prepare two kinds of article discharging apparatuses having different widths corresponding to the type of the article storage rack, that is, an article having a relatively smaller maximum width and an article having a relatively larger maximum width and to install an article discharging apparatus having a width corresponding to the maximum width of articles to be stored in the article storage rack in the article storage rack.

It is an object of the disclosure to at least partially solve the problems in the conventional technology.

In some embodiments, an article dispensing apparatus includes: one article discharging apparatus that is used for one article storage passage configured to store therein charged articles in an up-and-down direction, the one article discharging apparatus being configured to prevent the articles stored in the one article storage passage from moving downward in a discharge standby state, and discharge the lowermost article stored in the one article storage passage downward when being driven; and another article discharging apparatus that is used for another article storage passage that is adjacent to the one article storage passage, the other article discharging apparatus being configured to store therein charged articles in the up-and-down direction, the other article discharging apparatus being configured to prevent the articles stored in the other article storage passage from moving downward in a discharge standby state, and discharge the lowermost article stored in the other article storage passage downward when being driven, the one article discharging apparatus and the other article discharging apparatus being capable of being combined in a back-to-back manner. The one article discharging apparatus includes: a driving source for the one article dispensing apparatus and the other article dispensing apparatus; an output gear arranged rotatably forward and backward about a central axis of the output gear, the output gear being configured to rotate in one direction by a driving force from the driving source from a preset standby position when a discharging instruction has been given to the one article discharging apparatus, and rotate in another direction from the standby position by a driving force from the driving source when a discharging instruction has been given to the other article discharging apparatus; link levers where each link lever is provided rotatably about an axis of the link lever corresponding to each article discharging apparatus, and is configured to put the corresponding article discharging apparatus into a discharge standby state in a normal state, and drive the corresponding article discharging apparatus when a driving force is given to the link lever by a rotation of the output gear and the link lever is rotated by the driving force; and a controller configured to, when the output gear is rotated from the standby position by the discharging instruction, prohibit stopping of drive of the driving source to allow the rotation of the output gear until a preset prohibited time elapses from starting of the rotation of the output gear even when supply of electric power to the driving source is interrupted.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

The following describes a preferred embodiment of an article dispensing apparatus according to the disclosure in detail with reference to the accompanying drawings.

Figure 1:
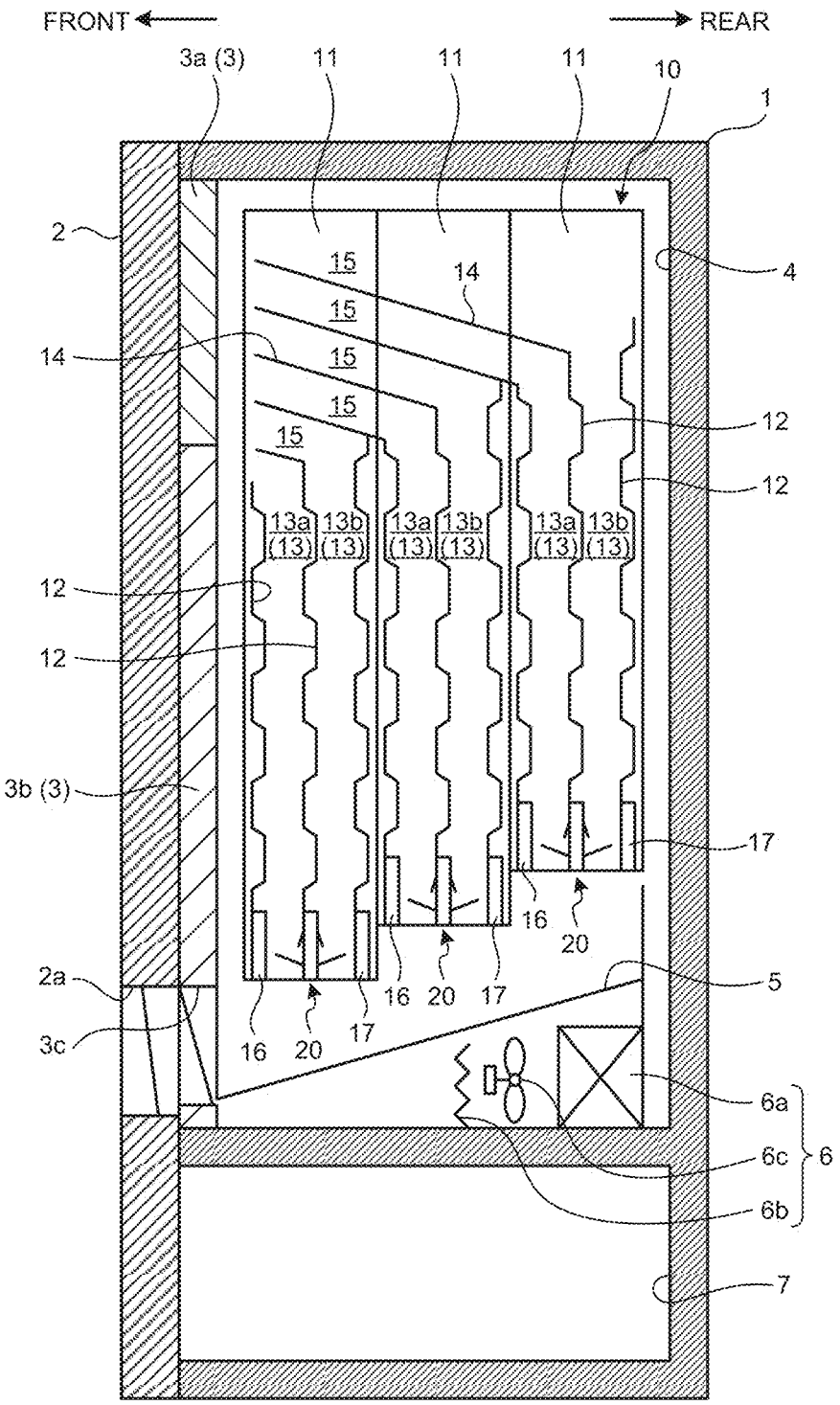
FIG. 1 is a sectional side view when viewing an internal structure of a vending machine in which an article dispensing apparatus as an embodiment of the disclosure is used from the right.

FIG. 1 is a sectional side view when viewing an internal structure of a vending machine in which the article dispensing apparatus as the embodiment of the disclosure is used from the right. The vending machine illustrated in this example sells articles cooled or heated and includes a main body cabinet 1, an outer door 2, and an inner door 3.

The main body cabinet 1 is formed in a rectangular parallelepipedal shape with its front open by combining a plurality of steel sheets as appropriate and includes an article storage 4 with a heat insulating structure thereinside. The outer door 2 is for covering the front opening of the main body cabinet 1 and is arranged on one side edge of the main body cabinet 1 in an openable and closable manner. Provided on the front face of this outer door 2 are requirements for selling articles such as a display window, article selection buttons, a bill insertion port, a coin slot, a return lever, an integral display, a coin drop, and an article outlet port 2*a*. The inner door 3 is a heat insulting door divided into up-and-down two parts for covering the front opening of the article storage 4, in which inside the outer door 2 an upper heat insulating door 3*a* is arranged on one side edge of the outer door 2 in an openable and closable manner, whereas a lower heat insulating door 3*b* is arranged on one side edge of the main body cabinet 1 in an openable and closable manner. An article discharging port 3*c* for discharging articles outside the article storage 4 is provided below the lower heat insulating door 3*b* of the inner door 3.

In the vending machine, an article chute 5 is provided inside the article storage 4; a temperature adjusting unit 6 is arranged in an area (hereinafter, also referred to as a "heat exchange area") below this article chute 5, whereas article storage racks 10 are arranged in an area (hereinafter, also referred to as an "article storage area") above this article chute 5.

The article chute 5 is a plate-shaped member for guiding articles discharged from the article storage racks 10 to the article discharging port 3*c* of the inner door 3 and is arranged in such a manner as to gradually incline downward toward the front. Although not being explicitly illustrated in the drawing, this article chute 5 is formed with many vent holes causing the heat exchange area and the article storage area to communicate with each other.

The temperature adjusting unit 6 is for maintaining the internal atmosphere of the article storage 4 at a desired temperature condition and includes an evaporator 6*a* for the refrigerating cycle, an electric heater 6*b*, and an air-blowing fan 6*c*. In this temperature adjusting unit 6, when the air-blowing fan 6*c* is driven with the refrigerating cycle operated, for example, air cooled by the evaporator 6*a* is supplied upward through the vent holes of the article chute 5, whereby the article storage area can be maintained at a low temperature state. In contrast, when the air-blowing fan 6*c* is driven with the electric heater 6*b* energized, air heated by the electric heater 6*b* is supplied upward through the vent holes of the article chute 5, whereby the article storage area can be maintained at a high temperature state. A compressor and a condenser for the refrigerating cycle and an expansion valve are arranged in a machinery room 7 outside the article storage 4, although they are not explicitly illustrated in the drawing.

The article storage racks 10 are arranged in three rows fore and aft, include a plurality of (two in the illustrated example) article storage passages 13 formed zigzag in an up-and-down direction by arranging passage forming elements 12 between a pair of base side plates 11, and store a plurality of articles with an attitude turned on their sides in the up-and-down direction inside these article storage passages 13. More specifically, the passage forming elements 12 are arranged as appropriate so as to face each other on the front side and the rear side of the article storage passage 13 and are fixed to the base side plates 11. With this configuration, in each of the article storage racks 10, the two article storage passages 13 are provided in such a manner as to be adjacent to each other fore and aft. In the following description, in one article storage rack 10, the front article storage passage 13 will be referred to also as a first article storage passage 13*a*, whereas the rear article storage passage 13 will be referred to also as a second article storage passage 13*b*.

The passage forming element 12 is provided with a flapper, which is not explicitly illustrated in the drawing. The flapper is swingably arranged on the passage forming element 12 in such a manner as to advance and retract to and from the article storage passage 13. This flapper is in an attitude advanced to the article storage passage 13 in a normal state by being biased by a coil spring (not illustrated). Coming into contact with an article passing through the article storage passage 13, the flapper itself retracts so as to be along the zigzag article storage passage 13 against the biasing force of the coil spring to correct the attitude of the article.

In each of the article storage racks 10, a top tray 14 is provided at the upper part of the article storage passage 13, whereas an article dispensing apparatus 20 is provided at the lower part of the article storage passage 13.

The top tray 14 is formed by bending plate-shaped sheet metal and is arranged between the base side plates 11 in such a manner as to gradually incline downward from the front toward the rear. The upper face of this top tray 14 forms an article guiding passage 15 that guides articles charged through a charging port to the article storage passage 13.

Figure 2:
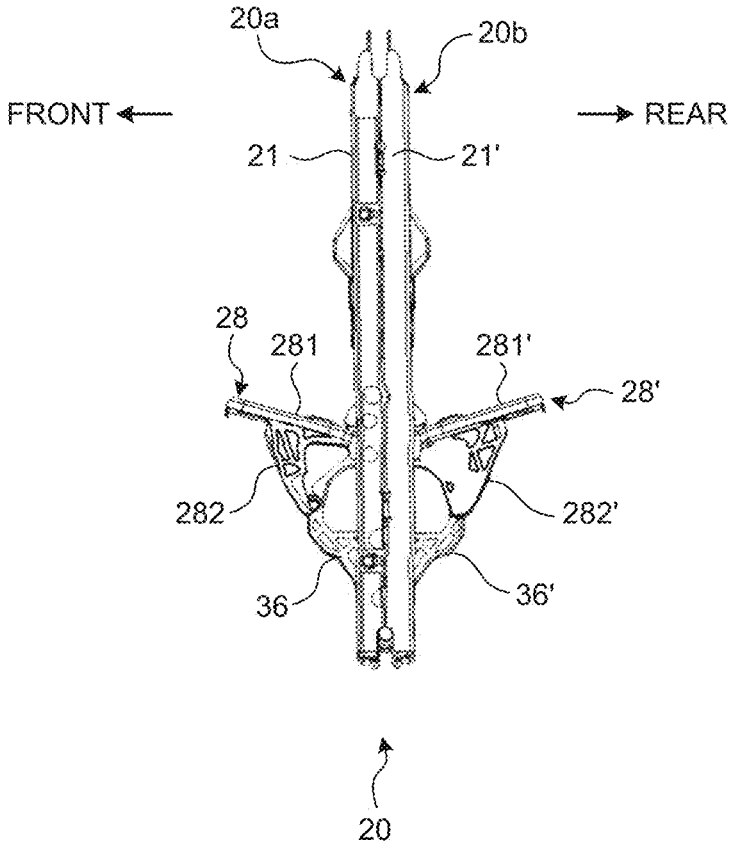
FIG. 2 is a side view when viewing the article dispensing apparatus illustrated in FIG. 1 from the right.
Figure 3:
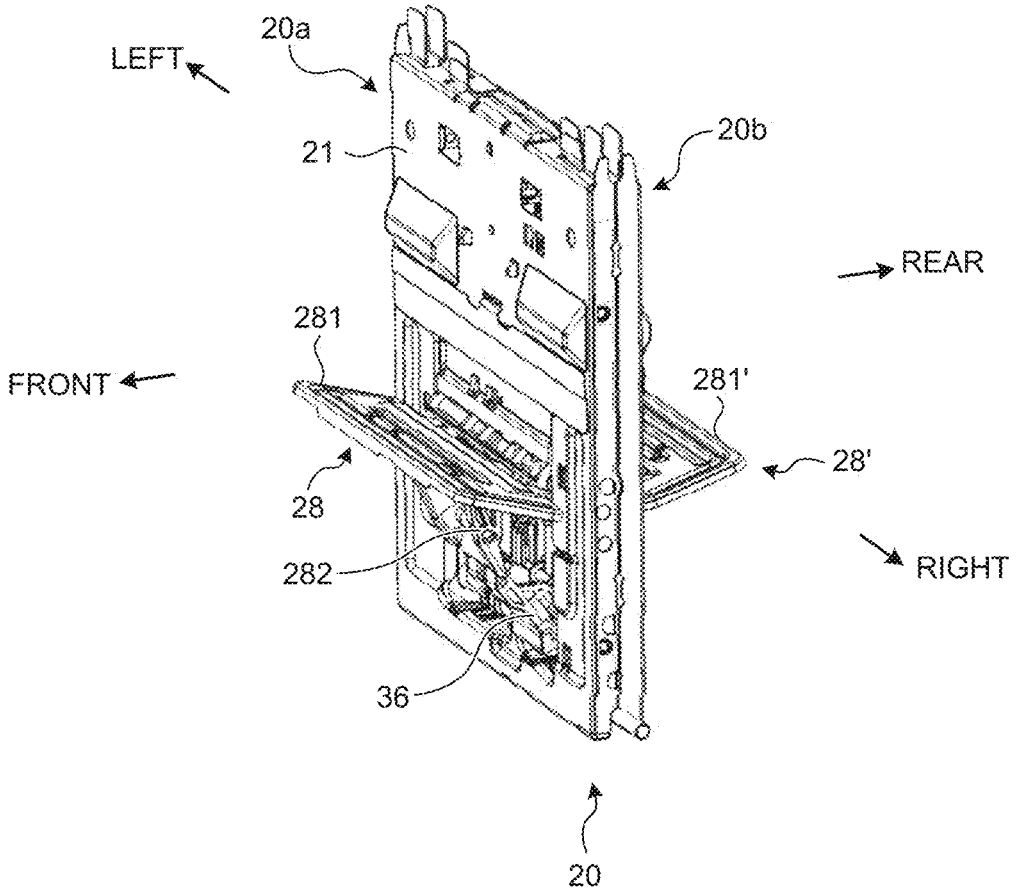
FIG. 3 is a perspective view when viewing the article dispensing apparatus illustrated in FIG. 1 from the right front.
Figure 4:
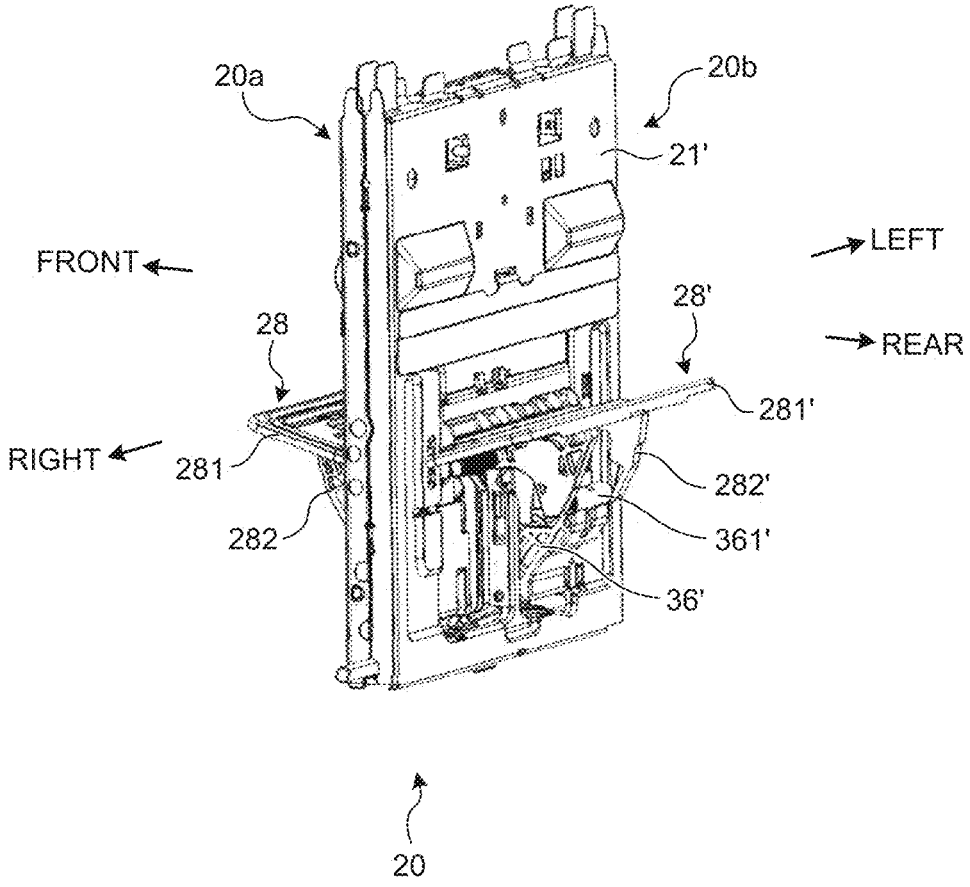
FIG. 4 is a perspective view when viewing the article dispensing apparatus illustrated in FIG. 1 from the right rear.

FIG. 2 to FIG. 4 illustrate the article dispensing apparatus 20 illustrated in FIG. 1: FIG. 2 is a side view when viewed from the right; FIG. 3 is a perspective view when viewed from the right front; and FIG. 4 is a perspective view when viewed from the right rear.

As illustrated in FIG. 2 to FIG. 4, the article dispensing apparatus 20 includes one article discharging apparatus (hereinafter, referred to also as a first article discharging apparatus) 20*a* and another article discharging apparatus (hereinafter, referred to also as a second article discharging apparatus) 20*b*, in which the first article discharging apparatus 20*a* and the second article discharging apparatus 20*b* are combined in a back-to-back manner. FIG. 2 to FIG. 4 illustrate a state in which no article is stored in both the first article discharging apparatus 20*a* and the second article discharging apparatus 20*b* included in the article dispensing apparatus 20.

Figure 5:
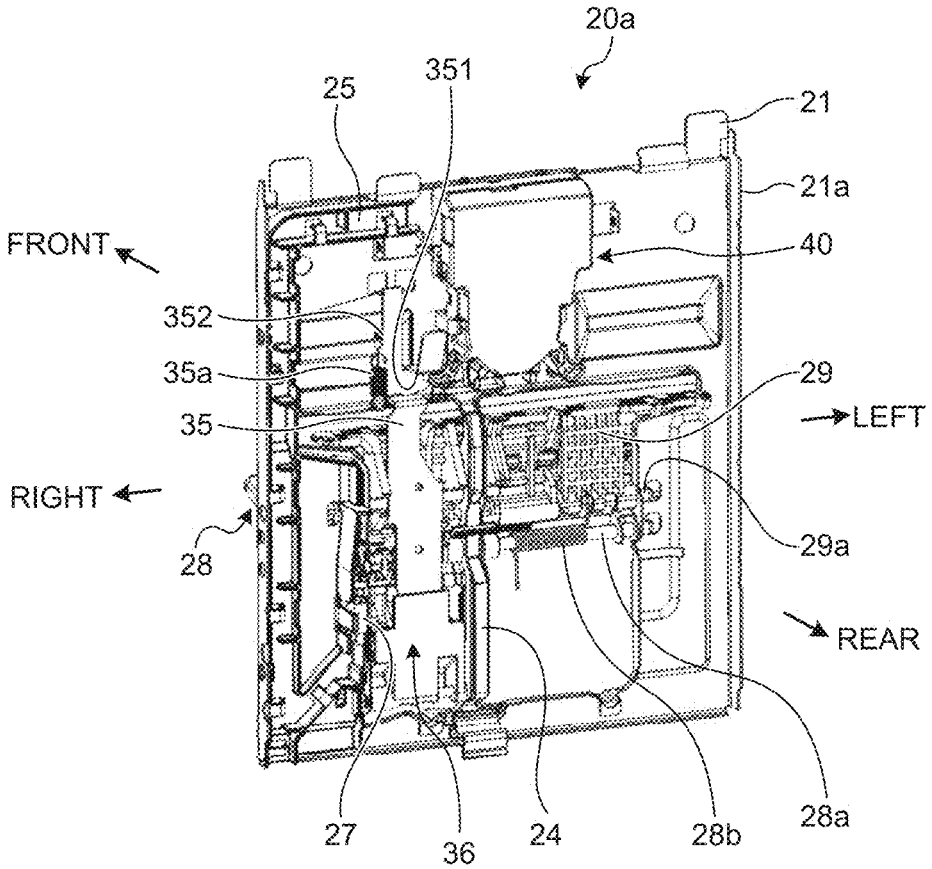
FIG. 5 is a perspective view when viewing a first article discharging apparatus illustrated in FIG. 2 to FIG. 4 from the right rear.

FIG. 5 is a perspective view when viewing the first article discharging apparatus 20*a* illustrated in FIG. 2 to FIG. 4 from the right rear. The following describes a configuration of the first article discharging apparatus 20*a* and then describes the second article discharging apparatus 20*b*.

Figure 6:
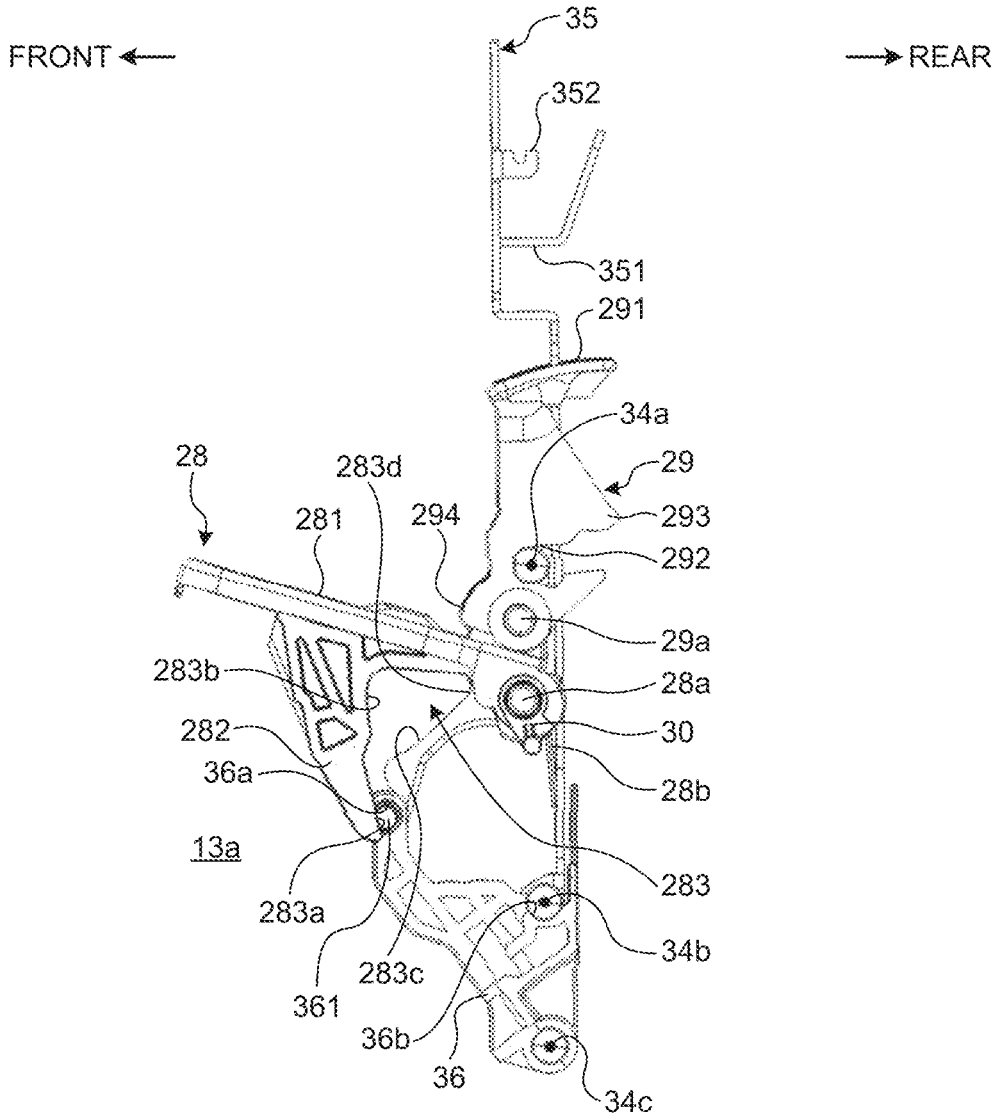
FIG. 6 is a schematic illustrative diagram when viewing a principal part of the first article discharging apparatus illustrated in FIG. 2 to FIG. 5 from the right.
Figure 7:
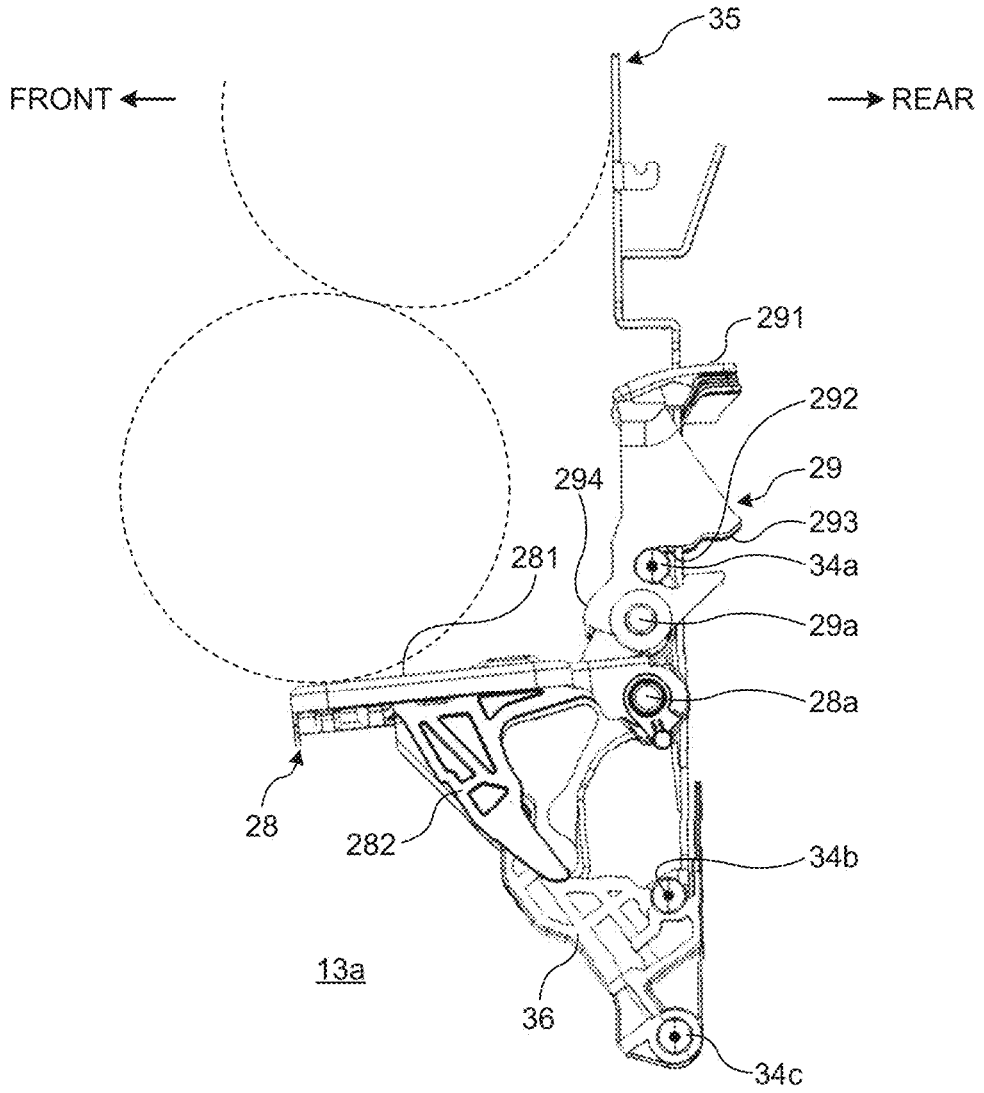
FIG. 7 is a schematic illustrative diagram when viewing the principal part of the first article discharging apparatus illustrated in FIG. 2 to FIG. 5 from the right.
Figure 8:
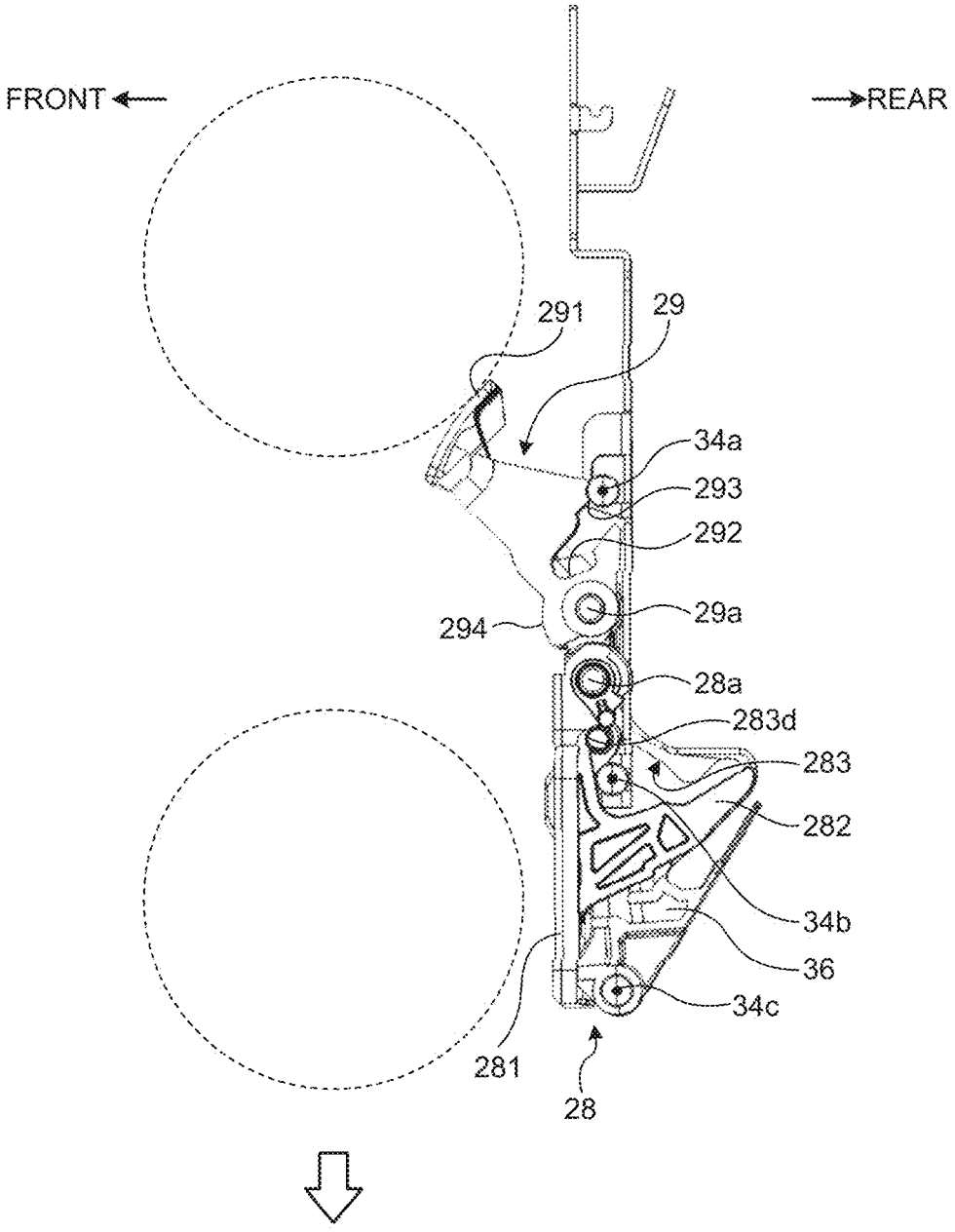
FIG. 8 is a schematic illustrative diagram when viewing the principal part of the first article discharging apparatus illustrated in FIG. 2 to FIG. 5 from the right.

FIG. 6 to FIG. 8 are schematic illustrative diagrams when viewing a principal part of the first article discharging apparatus 20*a* illustrated in FIG. 2 to FIG. 5 from the right. The following describes the configuration of the first article discharging apparatus 20*a* with reference also to FIG. 6 to FIG. 8 as appropriate.

The first article discharging apparatus 20*a* is used for the first article storage passage 13*a* and arranged at the lower part of this first article storage passage 13*a*. This first article discharging apparatus 20*a* controls the behavior of articles between the first article discharging apparatus 20*a* and a passage width defining plate 16 facing it, thereby functioning to store the articles in the first article storage passage 13*a* in a discharge standby state and to discharge a corresponding article one by one to the article chute 5 when being driven and includes a base 21.

Figure 9:
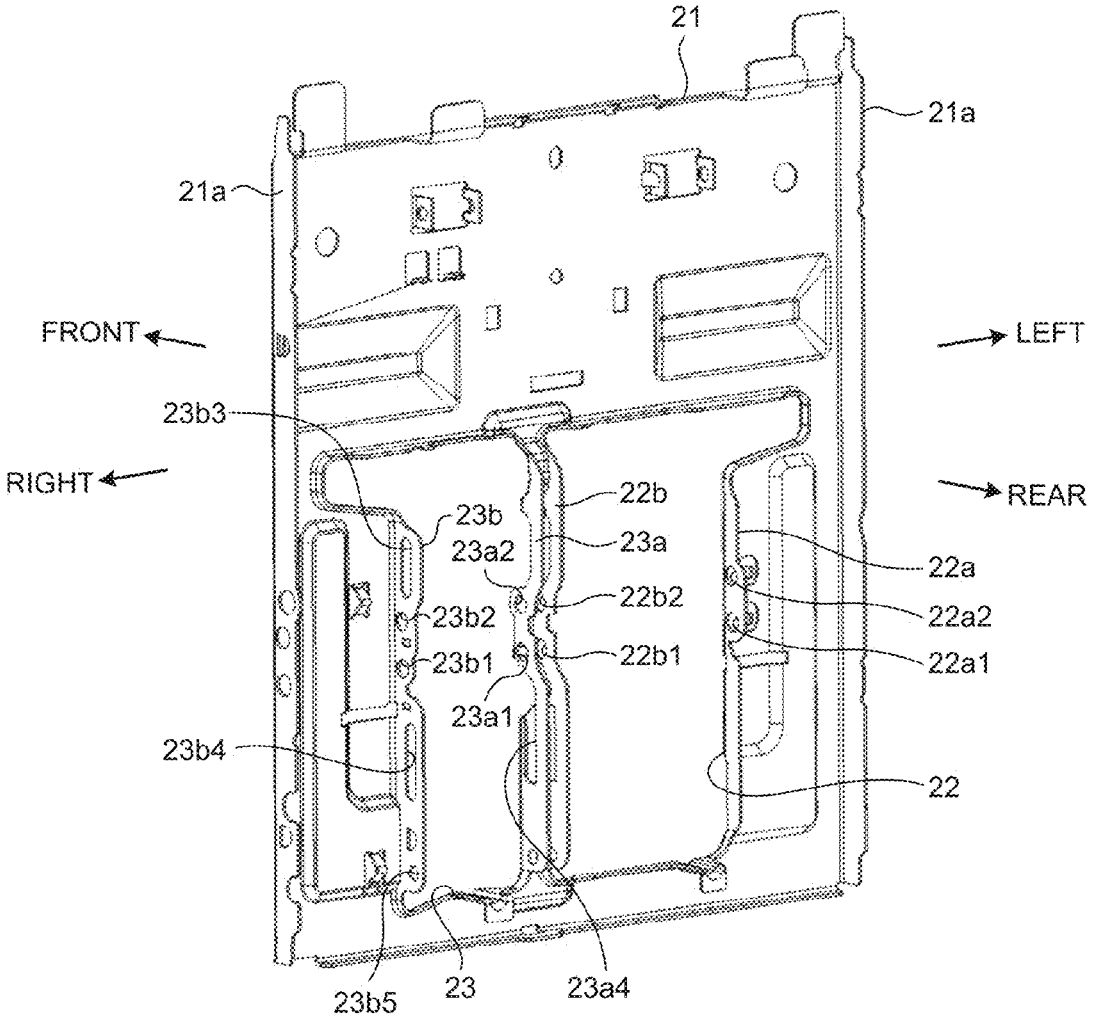
FIG. 9 is a perspective view of a base of the first article discharging apparatus illustrated in FIG. 2 to FIG. 5.

As illustrated in FIG. 9, the base 21 is formed by performing cutting and bending on a steel sheet and is arranged in such a manner as to cause its surface to face the passage width defining plate 16. This base 21 is formed with side walls 21*a* by causing its both ends to be bent and is formed with a first insertion hole 22 and a second insertion hole 23 in its intermediate part. The peripheries of the first insertion hole 22 and the second insertion hole 23 are bent similarly to the side walls 21*a* to form flanges.

The first insertion hole 22 and the second insertion hole 23 are formed so as to be next to each other right and left and have the same up-and-down dimension. As to the first insertion hole 22 and the second insertion hole 23, the first insertion hole 22 is positioned on the left side of the second insertion hole 23, and the right-and-left width of the first insertion hole 22 is larger than the right-and-left width of the second insertion hole 23. The first insertion hole 22 and the second insertion hole 23 are both through openings (recesses causing a lower pedal 28 and an upper pedal 29 described below to retract to within the base 21) formed in a substantially rectangular shape as a whole; the upper end of the first insertion hole 22 protrudes leftward, whereas the upper end of the second insertion hole 23 protrudes rightward. A first left shaft support piece 22*a* is provided on the left side edge of the first insertion hole 22, whereas a first right shaft support piece 22*b* is provide on the right side edge of the first insertion hole 22; a second left shaft support piece 23*a* is provided on the left side edge of the second insertion hole 23, whereas a second right shaft support piece 23*b* is provided on the right side edge of the second insertion hole 23. The first left shaft support piece 22*a* and the second right shaft support piece 23*b* correspond to the flanges formed on the peripheries of the first insertion hole 22 and the second insertion hole 23. The first right shaft support piece 22*b* and the second left shaft support piece 23*a* are formed in shaft inserting flanges forming U-shaped both leg pieces in a shaft support holding part that is formed integrally with the base 21 and is formed to have a U-shaped transverse cross section (discontinuous) that holds a shaft support part 24 described below in a fitted manner. This shaft support holding part has a function of maintaining the strength of the base 21 also when a large through opening including the first insertion hole 22 and the second insertion hole 23 formed in a substantially rectangular shape as a whole is formed in the base 21.

Figure 10:
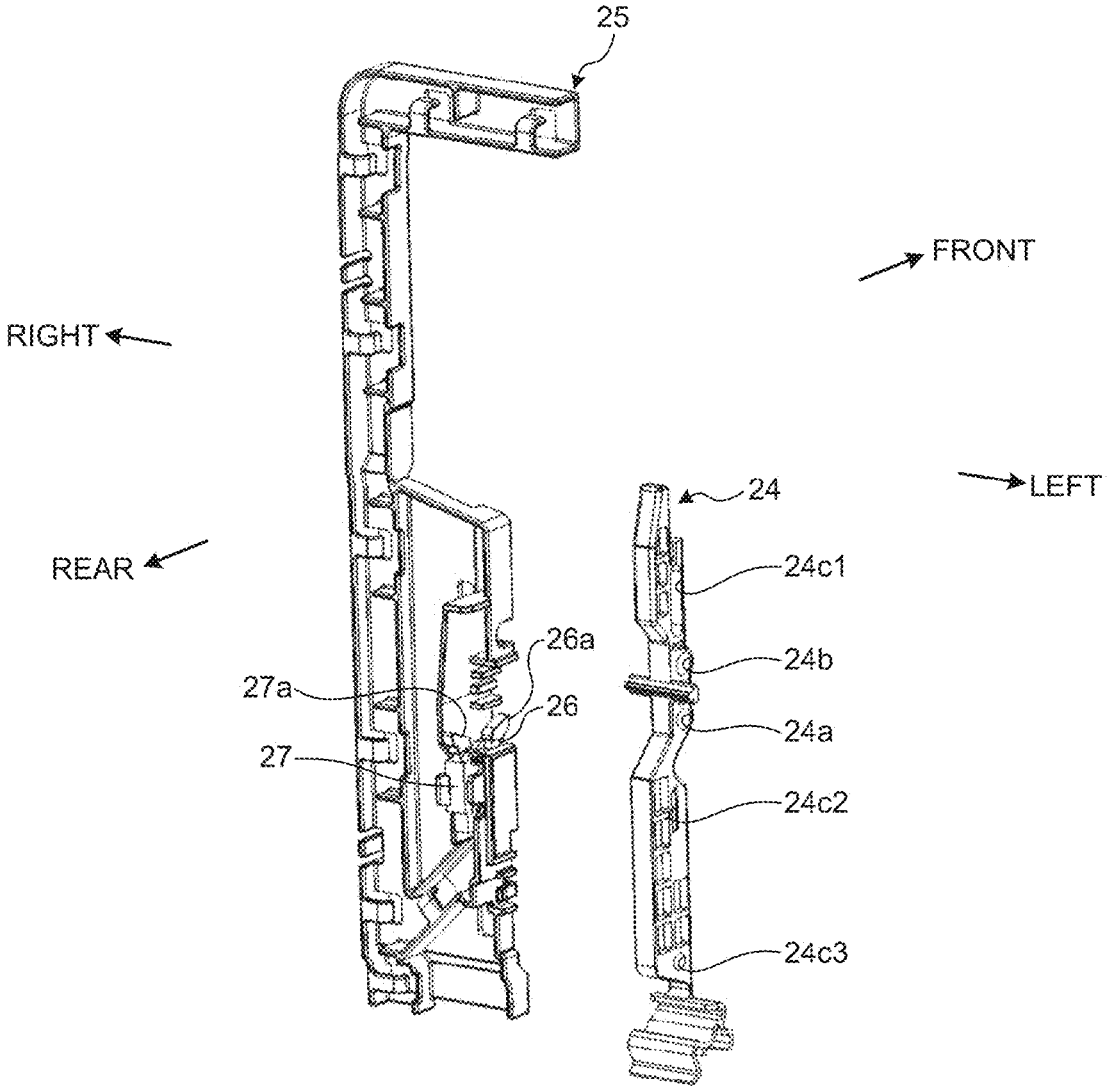
FIG. 10 is a perspective view of a shaft support part and a harness guide mounted on the base illustrated in FIG. 9.

The shaft support part 24 and a harness guide 25 as illustrated in FIG. 10 are mounted on the base 21 having the above configuration. The shaft support part 24 is formed of a resin material or the like and is fitted into between the first right shaft support piece 22*b* and the second left shaft support piece 23*a*.

The harness guide 25 is formed of a resin material or the like similarly to the shaft support part 24 and is fitted along the right side wall 21*a* of the base 21 in such a manner as to being adjacent to the second right shaft support piece 23*b*. This harness guide 25 is for routing a harness of electric parts mounted on the first article discharging apparatus 20*a*. In addition, the harness guide 25 has a role of a guide member when the first article discharging apparatus 20*a* and the second article discharging apparatus 20*b* are combined in a back-to-back manner.

Arranged on the harness guide 25 are a first out-of-stock detection switch 26 and a second out-of-stock detection switch 27.

The first out-of-stock detection switch 26 is arranged so as to be aligned with the second out-of-stock detection switch 27 fore and aft and is positioned on the front side of the second out-of-stock detection switch 27. This first out-of-stock detection switch 26 is what is called a push type switch and includes a contact maker 26*a* biased to be erected by a spring (not illustrated). The first out-of-stock detection switch 26 is turned to an off state to send an off signal to a dispensing controller 60 described below with the contact maker 26*a* not pressed and is turned to an on state to send an on signal to the dispensing controller 60 when the contact maker 26*a* is pressed to be displaced against the biasing force of the spring.

In the present embodiment, the first out-of-stock detection switch 26 is turned to the off state with the contact maker 26*a* not pressed and is turned to the on state when the contact maker 26*a* is pressed to be displaced; in the disclosure, the first out-of-stock detection switch 26 may be turned to the on state with the contact maker 26*a* not pressed and be turned to the off state when the contact maker 26*a* is pressed to be displaced.

The second out-of-stock detection switch 27 is positioned on the rear side of the first out-of-stock detection switch 26. This second out-of-stock detection switch 27 is what is called a push type switch and includes a contact maker 27*a* biased to be erected by a spring (not illustrated). The second out-of-stock detection switch 27 is turned to an off state to send an off signal to the dispensing controller 60 described below with the contact maker 27*a* not pressed and is turned to an on state to send an on signal to the dispensing controller 60 when the contact maker 27*a* is pressed to be displaced against the biasing force of the spring.

In the present embodiment, the second out-of-stock detection switch 27 is turned to the off state with the contact maker 27*a* not pressed and is turned to the on state when the contact maker 27*a* is pressed to be displaced; in the disclosure, the second out-of-stock detection switch 27 may be turned to the on state with the contact maker 27*a* not pressed and be turned to the off state when the contact maker 27*a* is pressed to be displaced.

Provided on the base 21 are a first swinging support shaft 28*a* and a second swinging support shaft 29*a*. The first swinging support shaft 28*a* is a shaft-shaped member installed passing through open holes 22*a*1, 22*b*1, 23*a*1, 23*b*1, and 24*a* formed in the first left shaft support piece 22*a*, the first right shaft support piece 22*b*, the second left shaft support piece 23*a*, the second right shaft support piece 23*b*, and the shaft support part 24, respectively, in such a manner as to extend in a substantially horizontal direction and supports the lower pedal 28 at its intermediate part. A first out-of-stock link 30 is arranged at the right end of the first swinging support shaft 28*a*.

The second swinging support shaft 29*a* is a shaft-shaped member installed passing through open holes 22*a*2, 22*b*2, 23*a*2, 23*b*2, and 24*b* formed in the first left shaft support piece 22*a*, the first right shaft support piece 22*b*, the second left shaft support piece 23*a*, the second right shaft support piece 23*b*, and the shaft support part 24, respectively, in such a manner as to extend in the substantially horizontal direction in an area above the first swinging support shaft 28*a* and supports the upper pedal 29 at its intermediate part.

The lower pedal 28 is a plate-shaped member and causes the first swinging support shaft 28*a* to be inserted into its basal end to be thereby arranged in such a manner as to be swingable about the central axis of this first swinging support shaft 28*a*.

A tip of the lower pedal 28 extends in the radially outside direction of the first swinging support shaft 28*a* and can advance and retract to and from the first article storage passage 13*a* through the first insertion hole 22 and the second insertion hole 23 when the lower pedal 28 swings about the central axis of the first swinging support shaft 28*a*. In other words, the lower pedal 28 is arranged swingably in such a manner as to advance and retract to and from the first article storage passage 13*a*.

A lower pedal spring 28*b* is interposed between the lower pedal 28 and the base 21. The lower pedal spring 28*b* always biases the lower pedal 28 in an advancing direction to the first article storage passage 13*a*. More specifically, the lower pedal spring 28*b* sets the lower pedal 28 to a standby position (hereinafter, referred to also as an article-absent standby position) so as to position the tip of the lower pedal 28 above the first swinging support shaft 28*a* as illustrated in FIG. 6. When an article is placed on the top face of the lower pedal 28, the lower pedal spring 28*b* sets the lower pedal 28 to a standby position (hereinafter, referred to also as an article-present standby position) so as to position the tip of the lower pedal 28 at a height level equal to the first swinging support shaft 28*a* as illustrated in FIG. 7.

With this operation, the tip of the lower pedal 28 is positioned at an upper position when the lower pedal 28 is in the article-absent standby position than when the lower pedal 28 is at the article-present standby position.

Figure 11:
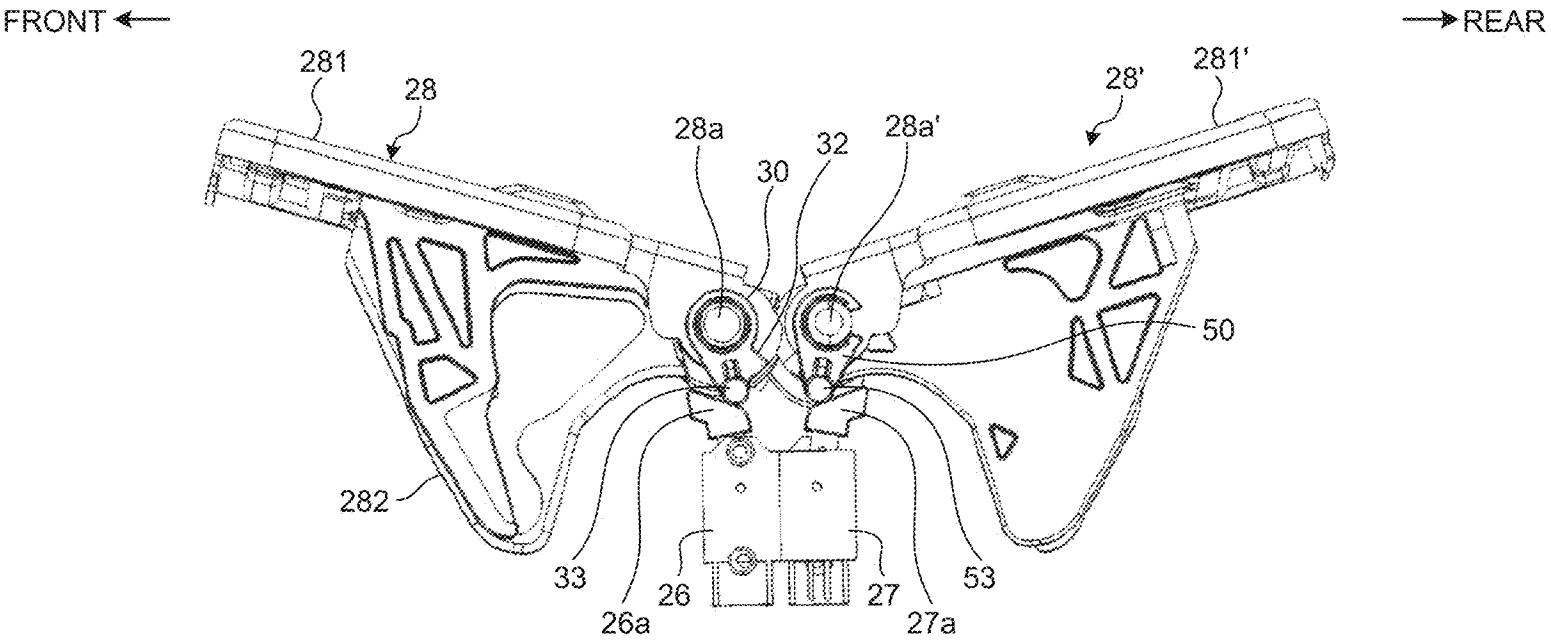
FIG. 11 is a side view of a principal part of the article dispensing apparatus in FIG. 2 to FIG. 4.

When the lower pedal 28 is in the article-absent standby position, the basal end of the lower pedal 28 comes into contact with a first out-of-stock contact part 32 of the first out-of-stock link 30 as illustrated in FIG. 11, whereby the first out-of-stock link 30 rotates about an axis of the first swinging support shaft 28*a*, whereby a first out-of-stock pressing part 33 presses the contact maker 26*a* of the first out-of-stock detection switch 26. With this operation, the contact maker 26*a* is pressed to be displaced frontward against the biasing force of the spring, whereby the first out-of-stock detection switch 26 is turned to the on state to send the on signal to the dispensing controller 60.

Figure 12:
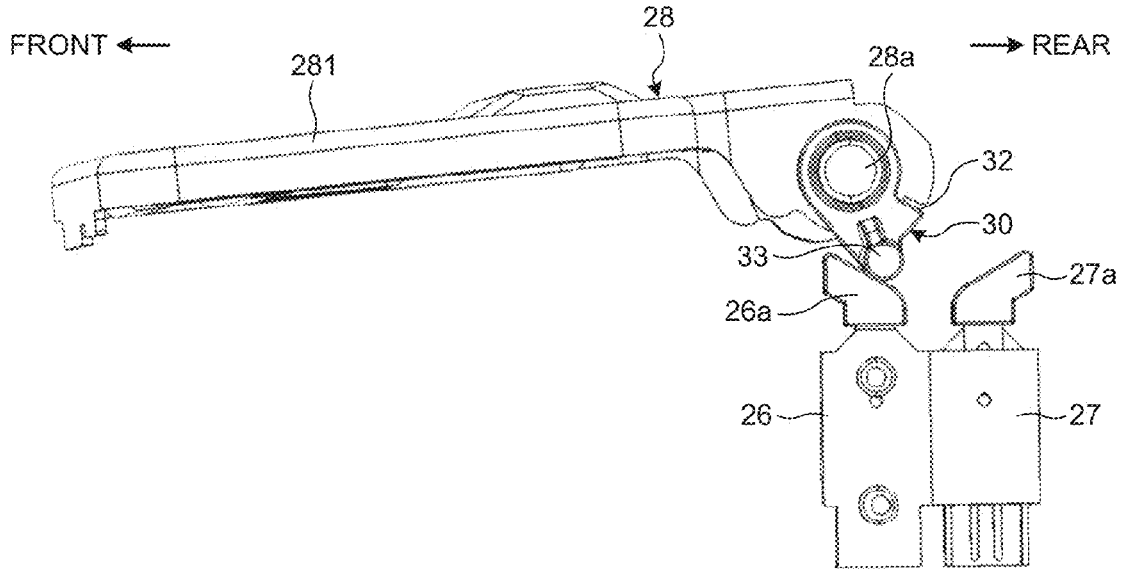
FIG. 12 is a side view of relation between a first out-of-stock link and a first out-of-stock detection switch when a lower pedal has been in an article-present standby position.

In contrast, when the lower pedal 28 is at the article-present standby position, the basal end of the lower pedal 28 separates from the first out-of-stock contact part 32 of the first out-of-stock link 30 as illustrated in FIG. 12, whereby the first out-of-stock link 30 becomes free. With this operation, the contact maker 26*a* is biased by the spring to be erected, whereby the first out-of-stock detection switch 26 is turned to the off state to send the off signal to the dispensing controller 60. In other words, the first out-of-stock pressing part 33 is pressed by the contact maker 26*a*, whereby the first out-of-stock link 30 that has become free rotates about the axis of the first swinging support shaft 28*a*.

The lower pedal 28 includes a plate-shaped pedal main body 281 and a pair of guide parts 282. The pair of guide parts 282 are provided on the back side of the pedal main body 281. The guide parts 282 are plate-shaped members extending in the up-and-down direction and are formed so as to face each other. Guide grooves 283 are formed on the facing faces facing each other of the respective guide parts 282.

The guide groove 283 includes a fitted-in part 283*a* that is positioned lowermost and in which a pedal operation shaft 361 of a turning stopper 36 described below is fitted in a state (the state illustrated in FIG. 6) in which the lower pedal 28 is arranged at an advanced position most advanced to the first article storage passage 13*a*, a contact part 283*d* that is positioned uppermost and with which the pedal operation shaft 361 of the turning stopper 36 comes into contact in a state (the state illustrated in FIG. 8) in which the lower pedal 28 is arranged at a retracted position most retracted from the first article storage passage 13*a*, and a first guide part 283*b* and a second guide part 283*c* that connect the fitted-in part 283*a* and the contact part 283*d* so as to make them continuous.

The first guide part 283*b* is formed in the guide part 282 in such a manner as to incline obliquely upward so as to separate from the fitted-in part 283*a* relative to the base 21, to incline obliquely upward so as to be close to the base 21, and to reach the contact part 283*d* in the state in which the lower pedal 28 is arranged at the position (the advanced position) most advanced relative to the first article storage passage 13*a*.

The second guide part 283*c* is formed in the guide part 282 in such a manner as to incline obliquely downward so as to separate from the contact part 283*d* relative to the base 21 and to reach the fitted-in part 283*a* in the state in which the lower pedal 28 is arranged at the position (the advanced position) most advanced to the first article storage passage 13*a*.

The radially outward length of this lower pedal 28 from the first swinging support shaft 28*a* is set to a length that can ensure a gap smaller than the maximum width of an article the maximum width of which is smaller between the lower pedal 28 and the passage width defining plate 16 when the lower pedal 28 is positioned at the position (the advanced position) most advanced to the first article storage passage 13*a*.

The upper pedal 29 is a plate-shaped member and causes the second swinging support shaft 29*a* to be inserted into its basal end to be thereby arranged on the base 21 in such a manner as to be swingable about the central axis of this second swinging support shaft 29*a*.

A tip of the upper pedal 29 extends in the radially outside direction of the second swinging support shaft 29*a* and can advance and retract to and from the first article storage passage 13*a* through the first insertion hole 22 and the second insertion hole 23 when the upper pedal 29 swings about the central axis of the second swinging support shaft 29*a*. In other words, the upper pedal 29 is arranged swingably in such a manner as to advance and retract to and from the first article storage passage 13*a*.

An upper pedal spring (not illustrated) is interposed between the upper pedal 29 and the base 21. The upper pedal spring always biases the upper pedal 29 in a retracting direction from the first article storage passage 13*a*.

The upper pedal 29 includes a pressing inclined face 291, a recess 292, a stopper contact part 293, and a protrusion 294. The pressing inclined face 291 is provided at the tip of the upper pedal 29 and is a curved inclined face formed in such a manner as to gradually lower toward the first article storage passage 13*a* when the upper pedal 29 is retracted from the first article storage passage 13*a*. The recess 292 is provided on the back side of the upper pedal 29 and is a line of recess extending in the substantially horizontal direction formed in such a manner as to open to both side faces of the upper pedal 29. The stopper contact part 293 is a part with which a stopper pin 34*a* described below comes into contact and is provided in such a manner as to incline above the recess 292 on the back side of the upper pedal 29.

The protrusion 294 is provided in such a manner as to protrude at the basal end of the upper pedal 29 toward the first article storage passage 13*a*.

This upper pedal 29 is biased to retract from the first article storage passage 13*a* by the biasing force of the upper pedal spring, and the stopper pin 34*a* comes into contact with the recess 292, whereby an initial position is set to the state in which the upper pedal 29 has retracted from the first article storage passage 13*a*.

This upper pedal 29 is inclined forward relative to a vertical plane passing through the second swinging support shaft 29*a* in a state (the state illustrated in FIG. 8) in which the upper pedal 29 is positioned at a position (an advanced position) most advanced to the first article storage passage 13*a*. The radially outward length of the upper pedal 29 from the second swinging support shaft 29*a* is set to a length that can ensure a gap smaller than the maximum width of an article the maximum width of which is smaller between the upper pedal 29 and the passage width defining plate 16 in the forward inclined state.

In the base 21, installed between the shaft support part 24 and the second right shaft support piece 23*b* are the stopper pin 34*a*, a pedal stopper pin 34*b*, and a stopper shaft 34*c*.

The stopper pin 34*a* is a shaft-shaped member arranged in the substantially horizontal direction between the shaft support part 24 and the second right shaft support piece 23*b*, one end of which is inserted into a stopper pin insertion hole 23*b*3 of the second right shaft support piece 23*b*, whereas the other end of which is inserted into a stopper pin insertion hole 24*c*1 of the shaft support part 24 exposed out of the second left shaft support piece 23*a*. This stopper pin 34*a* is connected to a pedal link 35 and can move in the up-and-down direction inside the stopper pin insertion holes 23*b*3 and 24*c*1 along with the movement in the up-and-down direction of the pedal link 35. The stopper pin 34*a* is in contact with the recess 292 of the upper pedal 29 in the initial position.

The pedal stopper pin 34*b* is a shaft-shaped member arranged in the substantially horizontal direction between the shaft support part 24 and the second right shaft support piece 23*b*, one end of which is inserted into a pedal stopper pin support groove 24*c*2 (an elongated groove extending up and down similar to the stopper pin insertion hole 24*c*1, is blocked by a groove bottom as a drawer part of the reference symbol 24*c*1, and is invisible in FIG. 6) of the shaft support part 24, whereas the other end of which is inserted into a pedal stopper pin support groove 23*b*4 of the second right shaft support piece 23*b*. An insertion groove 23*a*4 is provided in the second left shaft support piece 23*a* so as to expose the pedal stopper pin support groove 24*c*2. This pedal stopper pin 34*b* is connected to the pedal link 35 and can move in the up-and-down direction inside the pedal stopper pin support grooves 23*b*4 and 24*c*2 along with the movement in the up-and-down direction of the pedal link 35. The periphery of this pedal stopper pin 34*b* slides within the pedal stopper pin support grooves 23*b*4 and 24*c*2 when the pedal link 35 is moved in the up-and-down direction.

The stopper shaft 34*c* is a shaft-shaped member arranged in the substantially horizontal direction between the shaft support part 24 and the second right shaft support piece 23*b*, one end of which is inserted into a stopper shaft insertion hole 24*c*3 of the shaft support part 24, whereas the other end of which is inserted into an open hole 23*b*5 of the second right shaft support piece 23*b*. An insertion hole for the stopper shaft 34*c* is formed in the second left shaft support piece 23*a*. This stopper shaft 34*c* supports the turning stopper 36 in its intermediate part.

The turning stopper 36 causes the stopper shaft 34*c* to be inserted into its insertion hole of its basal end and is arranged between the shaft support part 24 and the second right shaft support piece 23*b* in such a manner as to be swingable about the central axis of this stopper shaft 34*c*.

A tip of the turning stopper 36 extends in the radially outside direction of the stopper shaft 34*c* and can advance and retract to and from the first article storage passage 13*a* through the second insertion hole 23 when the turning stopper 36 swings about the central axis of the stopper shaft 34*c*.

This turning stopper 36 causes the pedal operation shaft 361 to be inserted into an open hole 36*a* of the tip and thereby has the pedal operation shaft 361. The pedal operation shaft 361 is a shaft-shaped member arranged in the substantially horizontal direction, both ends of which are fitted in the guide grooves 283 of the lower pedal 28.

A pedal operation spring (not illustrated) is interposed between the turning stopper 36 and the base 21. The pedal operation spring always biases the turning stopper 36 in an advancing direction to the first article storage passage 13*a*.

This turning stopper 36 is biased in an advancing direction to the first article storage passage 13*a* by the pedal operation spring and is prevented from moving in a retracting direction by the pedal stopper pin 34*b* entering an indentation 36*b* of the turning stopper 36 and coming into contact with the pedal stopper pin 34*b*, and an initial position with the turning stopper 36 advanced to the first article storage passage 13*a* is set. The lower pedal 28 is biased by the lower pedal spring 28*b*, whereby the turning stopper 36 positions both ends of the pedal operation shaft 361 at the fitted-in parts 283*a* of the guide grooves 283 and sets an initial position at a position at which the lower pedal 28 has advanced to the first article storage passage 13*a*.

The pedal link 35 is an elongated plate-shaped member extending in the up-and-down direction, in which an upper part is bent frontward and then extends upward. Provided on the upper part of this pedal link 35 are a contact piece 351 that extends rearward and then extends obliquely upward and a locking part 352 that locks a link spring 35*a*. This link spring 35*a* is interposed between the pedal link 35 and the base 21 and always biases the pedal link 35 downward.

With the pedal link 35 biased by the link spring 35*a* and arranged at a lower position, the stopper pin 34*a* is arranged at the lower end of the stopper pin insertion holes 23*b*3 and 24*c*1, whereas the pedal stopper pin 34*b* is arranged at the lower end of the pedal stopper pin support grooves 23*b*4 and 24*c*2. In this state, the recess 292 of the upper pedal 29 arranged at the retracted position is in contact with the stopper pin 34*a*. Besides, the turning stopper 36 arranged at the advanced position is in contact with the pedal stopper pin 34*b*, thereby preventing the turning stopper 36 from retracting. In addition, the pedal operation shaft 361 of the turning stopper 36 arranged at the advanced position is fitted in the fitted-in parts 283*a* of the lower pedal 28, thereby preventing the lower pedal 28 arranged at the advanced position from retracting.

In contrast, with the pedal link 35 arranged at an upper position against the biasing force of the link spring 35*a*, as illustrated in FIG. 8, the stopper pin 34*a* is arranged at the upper end of the stopper pin insertion holes 23*b*3 and 24*c*1, whereas the pedal stopper pin 34*b* is arranged at the upper end of the pedal stopper pin support grooves 23*b*4 and 24*c*2. In this state, the stopper contact part 293 of the upper pedal 29 is in contact with the stopper pin 34*a*, thereby preventing the upper pedal 29 from retracting and causing the upper pedal 29 to advance against the biasing force of the upper pedal spring and to be arranged at the advanced position.

Meanwhile, the prevention of retracting for the turning stopper 36 by the pedal stopper pin 34*b* is released, and the prevention of retracting is released about the stopper shaft 34*c*. The load of the article in contact with the lower pedal 28 maintained at the advanced position by the turning stopper 36 is being applied to the turning stopper 36, and the prevention of retracting has been released, whereby the turning stopper 36 starts retracting. When the retracting of the turning stopper 36 is started, the pedal operation shaft 361 is detached from the fitted-in parts 283*a* of the lower pedal 28, whereby the lower pedal 28 is allowed to retract about the first swinging support shaft 28*a* and retracts against the elastic biasing force of the lower pedal spring 28*b* by the load of the article (refer to FIG. 8).

Figure 13:
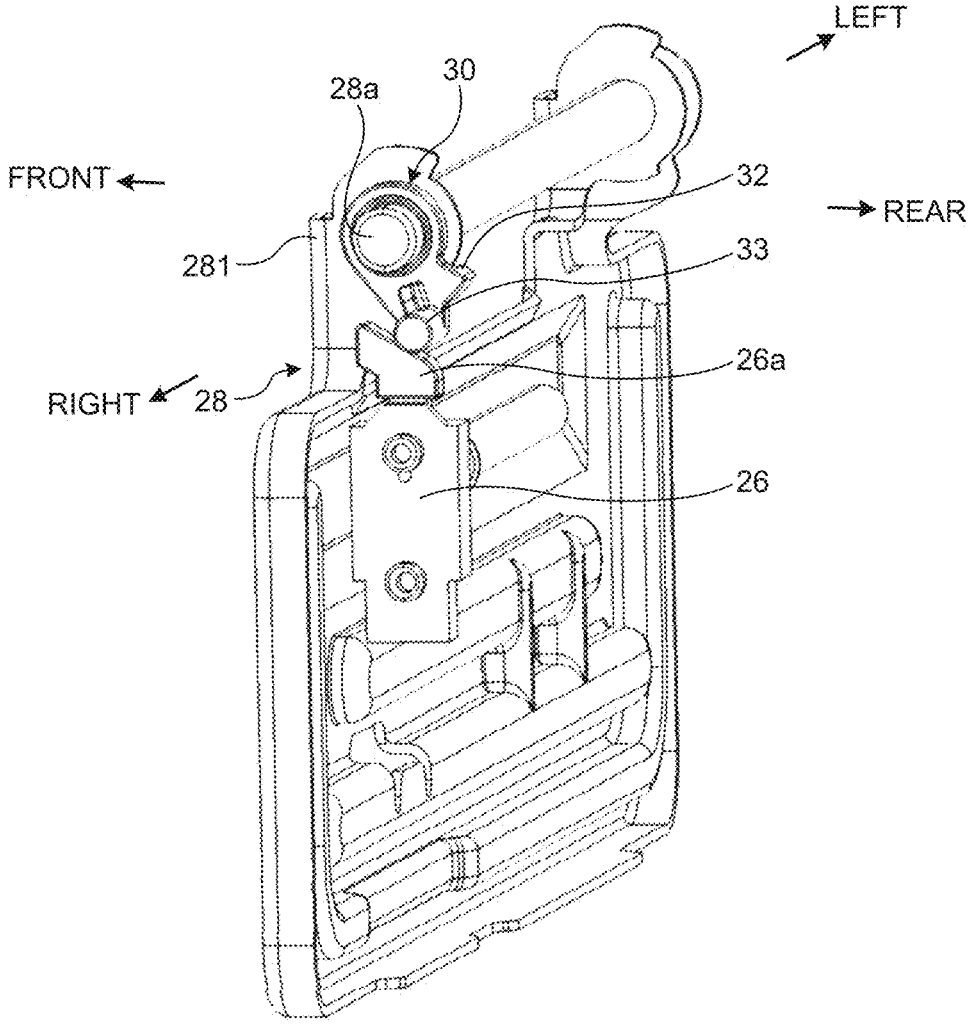
FIG. 13 is a perspective view of relation between the first out-of-stock link and the first out-of-stock detection switch when the lower pedal has retracted.

When the lower pedal 28 thus retracts, the basal end of the lower pedal 28 separates from the first out-of-stock contact part 32 of the first out-of-stock link 30 as illustrated in FIG. 13, whereby the first out-of-stock link 30 becomes free. With this operation, the contact maker 26*a* is pressed by the spring to be erected, whereby the first out-of-stock detection switch 26 maintains the off state. In other words, also when the lower pedal 28 retracts similarly to the article-present standby position, the first out-of-stock link 30 does not press the contact maker 26*a* of the first out-of-stock detection switch 26.

The first article discharging apparatus 20*a* having such a configuration includes a driving unit 40 in addition to the above configuration.

Figure 14:
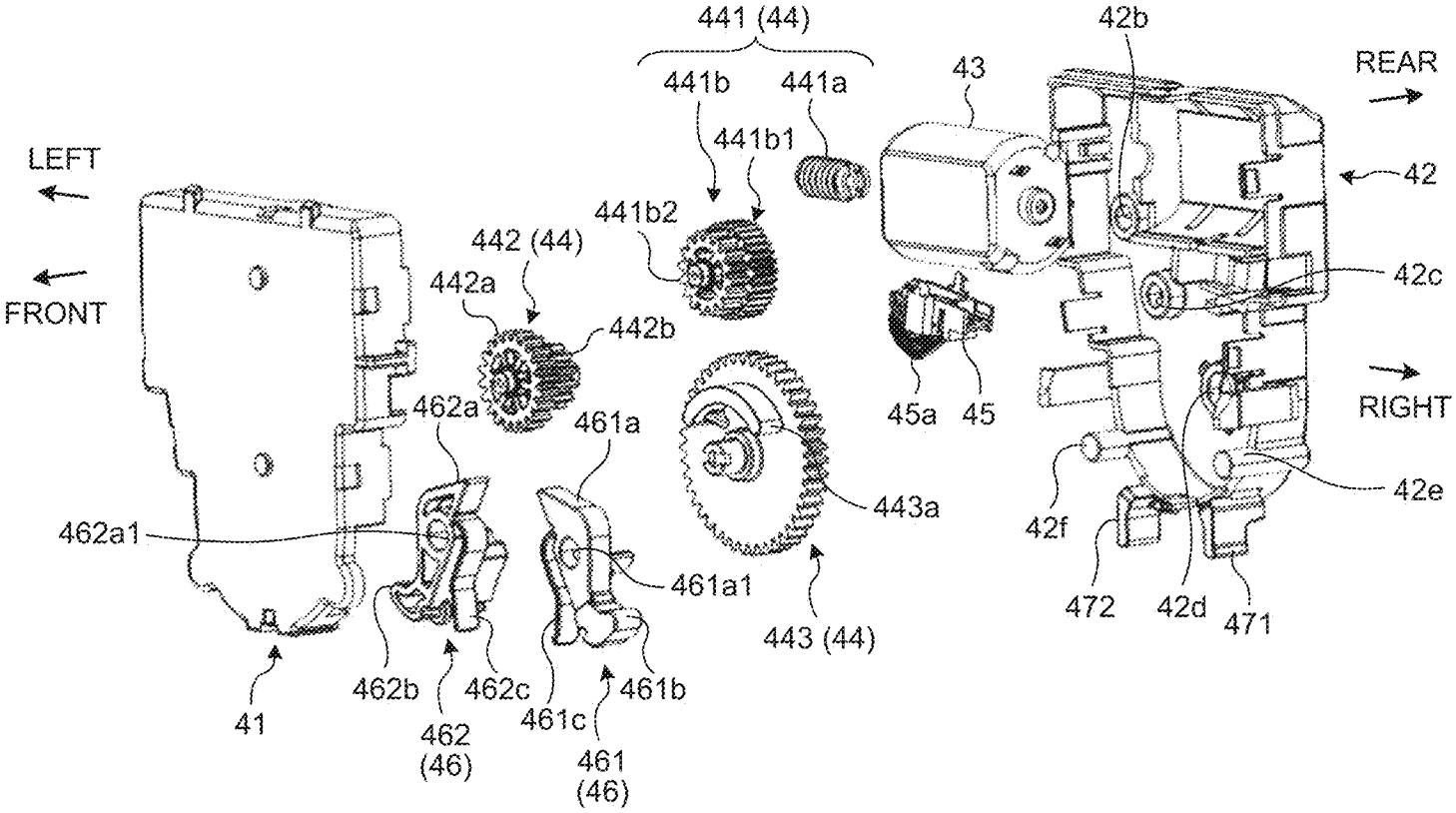
FIG. 14 is an exploded perspective view of a principal part of a driving unit in the first article discharging apparatus when viewed from the right front.
Figure 15:
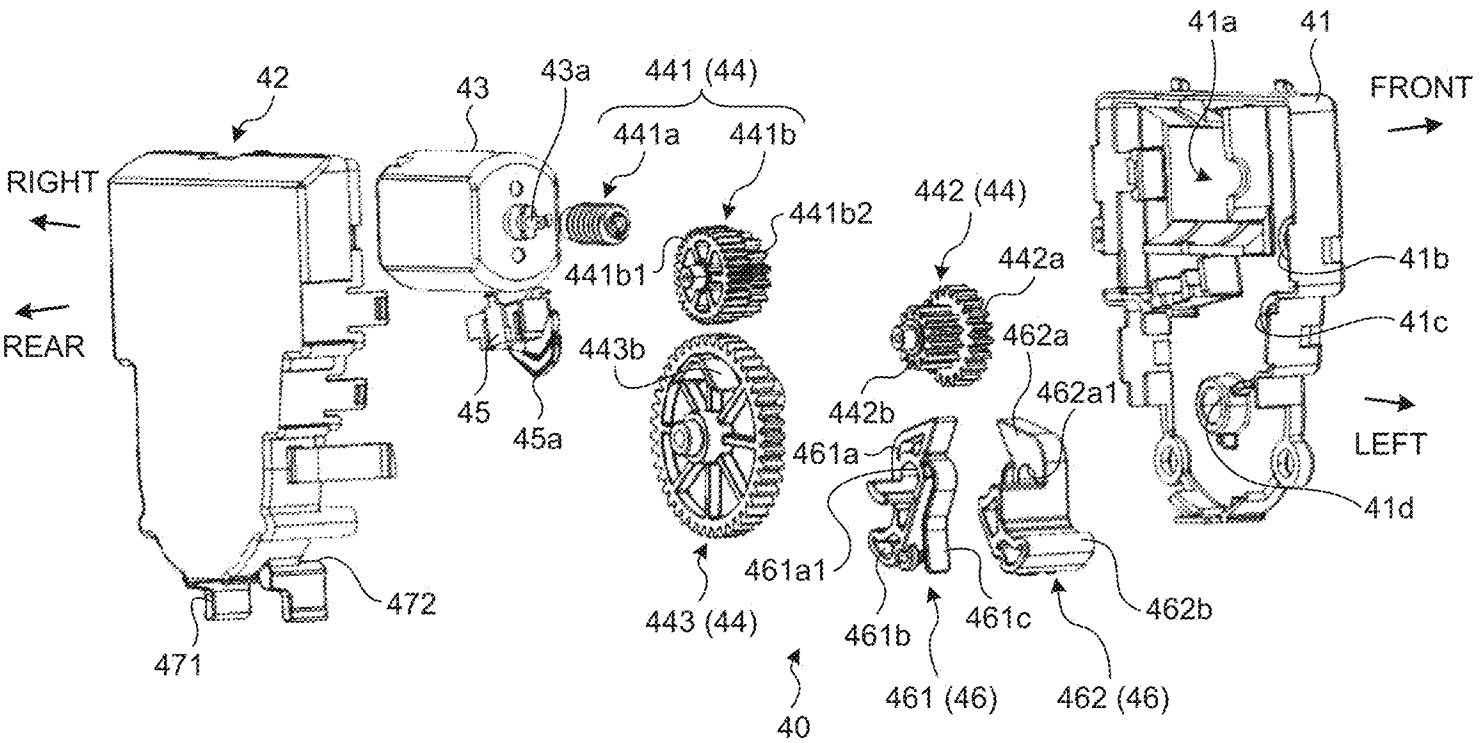
FIG. 15 is an exploded perspective view of the principal part of the driving unit in the first article discharging apparatus when viewed from the left rear.

FIG. 14 and FIG. 15 illustrate a principal part of the driving unit 40 in the first article discharging apparatus 20*a*: FIG. 14 is an exploded perspective view when viewed from the right front; and FIG. 15 is an exploded perspective view when viewed from the left rear.

The driving unit 40 is arranged at the central area at the upper part on the back side of the base 21. This driving unit 40 includes a unit base 41 mounted on the back side of the base 21.

The unit base 41 is formed of a resin material, for example, and is formed in a box shape with its rear face open. The unit base 41 blocks the rear opening by mounting a unit cover 42 formed of resin to form a housing space between the unit base 41 and the unit cover 42. Housed in the housing space thus formed by the unit base 41 and the unit cover 42 are a motor 43, a gear member 44, a carrier switch 45, and a link lever 46.

The motor 43 is a driving source and is a forward-and-backward rotatable direct-current (DC) motor that is driven in accordance with an instruction given from the dispensing controller 60 described below. The motor 43 is arranged by being held by a motor holding part 41*a* of the unit base 41.

The gear member 44 includes a worm gear 441, an intermediate gear 442, and an output gear 443. The worm gear 441 has a worm 441*a* and a worm wheel 441*b*.

The worm 441*a* is formed in a cylindrical shape and is mounted on an output shaft 43*a* of the motor 43. The worm wheel 441*b* has a disc-shaped first worm wheel 441*b*1 and a disc-shaped second worm wheel 441*b*2.

The first worm wheel 441*b*1 is formed with a shaft-shaped part protruding rearward at its central part and is formed with a gear part including a plurality of teeth on its periphery.

The second worm wheel 441*b*2 is positioned on the front side of the first worm wheel 441*b*1 and is formed with a shaft-shaped part the central axis of which is aligned with the central axis of the shaft-shaped part of the first worm wheel 441*b*1 in such a manner as to protrude frontward. The periphery of this second worm wheel 441*b*2 is also formed with a gear part including a plurality of teeth.

This worm wheel 441*b* is arranged rotatably about the central axis of the shaft-shaped part by, with the gear part of the first worm wheel 441*b*1 engaged with the worm 441*a*, inserting the shaft-shaped part into recesses 41*b* and 42*b* of the unit base 41 and the unit cover 42, respectively.

The intermediate gear 442 has a disc-shaped first intermediate gear 442*a* and a disc-shaped second intermediate gear 442*b*. The first intermediate gear 442*a* is formed with a shaft-shaped part protruding rearward at its central part and is formed with a gear part including a plurality of teeth on its periphery.

The second intermediate gear 442*b* is positioned on the rear side of the first intermediate gear 442*a* and is formed with a shaft-shaped part the central axis of which is aligned with the central axis of the shaft-shaped part of the first intermediate gear 442*a* in such a manner as to protrude frontward. The periphery of this second intermediate gear 442*b* is also formed with a gear part including a plurality of teeth.

This intermediate gear 442 is arranged rotatably about the central axis of the shaft-shaped part by, with the gear part of the first intermediate gear 442*a* engaged with the gear part of the second worm wheel 441*b*2, inserting the shaft-shaped part into recesses 41*c* and 42*c* of the unit base 41 and the unit cover 42, respectively.

The output gear 443 is formed in a disc shape having an enlarged diameter compared with those of the worm wheel 441*b* and the intermediate gear 442. The periphery of this output gear 443 is also formed with a plurality of teeth. The output gear 443 is formed with a shaft-shaped part protruding in a fore-and-aft direction at its central part. Further, the output gear 443 is formed with a cam part 443*a* on its front face and is formed with a pressing piece 443*b* on its rear face.

The cam part 443*a* is formed in an arc shape and is formed in such a manner as to protrude frontward. This cam part 443*a* is formed such that its arc length will be large enough to, after the pedal link 35 is moved upward, maintain that state.

The pressing piece 443*b* is formed in a substantially V shape and is formed in such a manner as to protrude rearward on the rear face as a face that is opposite the cam part 443*a*.

This output gear 443 is arranged rotatably about the central axis of the shaft-shaped part by, with the gear part engaged with the gear part of the second intermediate gear 442*b*, inserting the shaft-shaped part into recesses 41*d* and 42*d* of the unit base 41 and the unit cover 42, respectively.

The carrier switch 45 is what is called a push type switch and includes a contact maker 45*a*. This carrier switch 45 is arranged on the unit base 41 held at a slightly upper position than the area on which the output gear 443 is arranged. This carrier switch 45 is turned to an on state when the contact maker 45*a* is pressed and gives the fact as an on signal to the dispensing controller 60 and is turned to an off state when the contact maker 45*a* is not pressed and gives the fact as an off signal to the dispensing controller 60.

The link lever 46 includes a first link lever 461 and a second link lever 462. The first link lever 461 is formed of a resin material, for example, and is formed with an open hole 461*a*1 in a basal end 461*a*. This first link lever 461 is formed in a hook shape in which a tip 461*b* extends right downward from the basal end 461*a* and then curves right upward. In addition, a locking part 461*c* is provided on the basal end 461*a* of the first link lever 461. The locking part 461*c* is an elastically deformable, plate-shaped elastic member extending downward from the left end of the basal end 461*a*.

A first link shaft 42*e* provided in the unit cover 42 is inserted into the open hole 461*a*1 of the basal end 461*a*, whereby the first link lever 461 is arranged rotatably about the central axis of the first link shaft 42*e* on the front side of the output gear 443. In this case, the first link lever 461 passes through a right opening (not illustrated) formed by the unit base 41 and the unit cover 42, and the tip 461*b* is positioned outside the unit base 41 and the unit cover 42. The locking part 461*c* comes into contact with a left side edge 471 of the right opening, thereby determining the attitude of the first link lever 461 in the normal state.

The second link lever 462 is formed of a resin material, for example, and is formed with an open hole 462*a*1 in a basal end 462*a*. This second link lever 462 is formed in a hook shape in which a tip 462*b* extends left downward from the basal end 462*a* and then curves left upward. The tip 462*b* of this second link lever 462 is larger in fore-and-aft width than the tip 461*b* of the first link lever 461. Further, a locking part 462*c* is provided on the basal end 462*a* of the second link lever 462. The locking part 462*c* is an elastically deformable, plate-shaped elastic member extending downward from the right end of the basal end 462*a*.

A second link shaft 42*f* provided in the unit cover 42 is inserted into the open hole 462*a*1 of the basal end 462*a*, whereby the second link lever 462 is arranged rotatably about the central axis of the second link shaft 42*f* on the front side of the output gear 443. In this case, the second link lever 462 passes through a left opening (not illustrated) formed by the unit base 41 and the unit cover 42, and the tip 462*b* is positioned outside the unit base 41 and the unit cover 42. The locking part 462*c* comes into contact with a right side edge 472 of the left opening, thereby determining the attitude of the second link lever 462 in the normal state.

Figure 16:
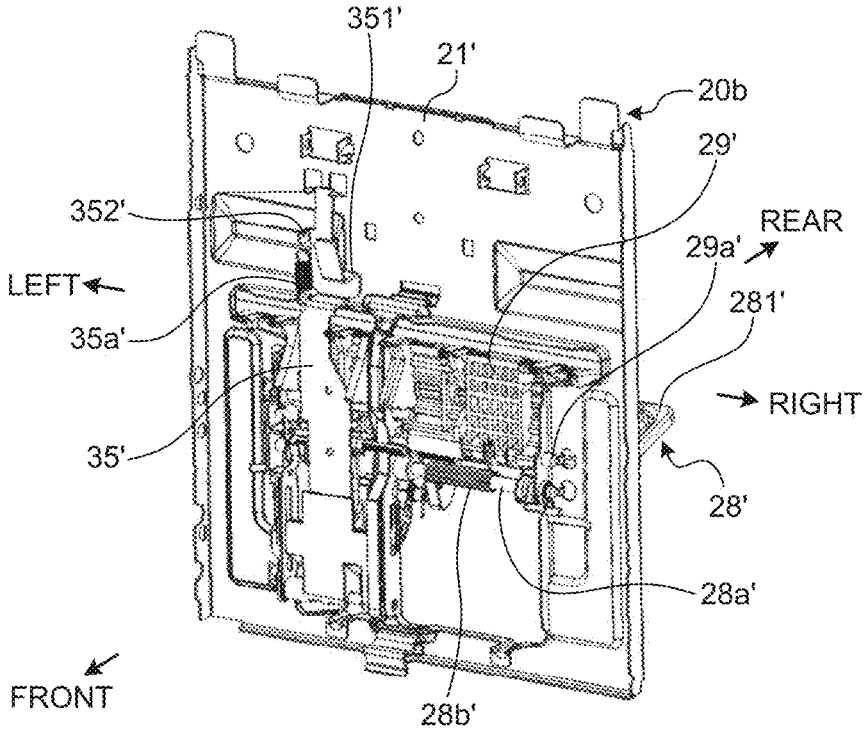
FIG. 16 is a perspective view when viewing a second article discharging apparatus illustrated in FIG. 2 to FIG. 4 from the right front.
Figure 17:
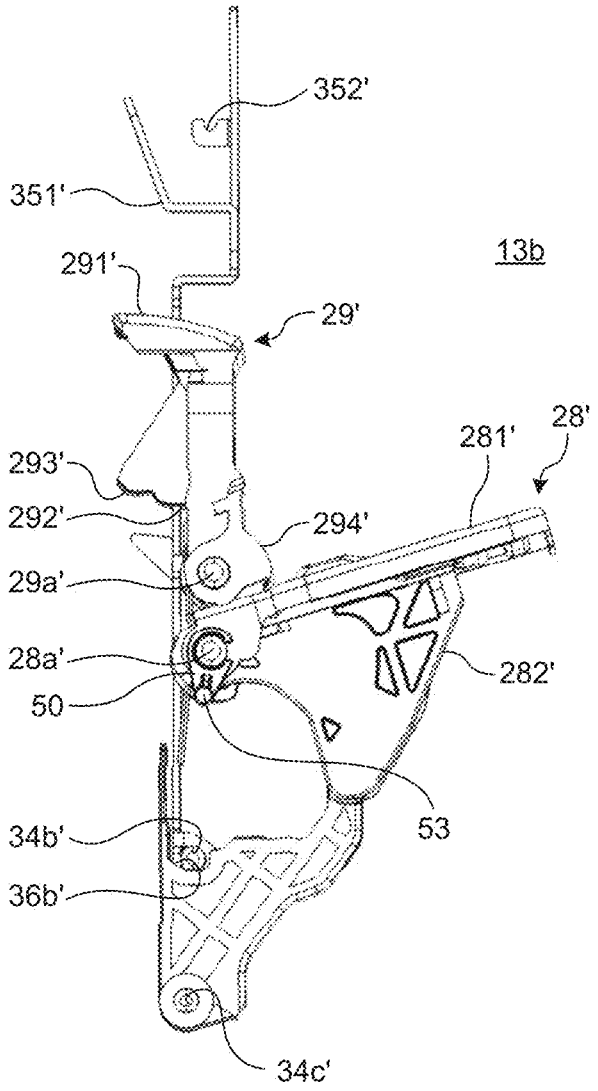
FIG. 17 is a schematic illustrative diagram when viewing a principal part of the second article discharging apparatus illustrated in FIG. 2 to FIG. 4 and FIG. 16 from the right.

FIG. 16 is a perspective view when viewing the second article discharging apparatus 20*b* illustrated in FIG. 2 to FIG. 4 from the right front. FIG. 17 is a schematic illustrative diagram when viewing a principal part of the second article discharging apparatus 20*b* illustrated in FIG. 2 to FIG. 4 and FIG. 16 from the right. Most of the components of the second article discharging apparatus 20*b* are common to the components of the first article discharging apparatus 20*a* and are different in fore-and-aft orientation from the components of the first article discharging apparatus 20*a* and are opposite in the right-and-left direction. Given this situation, the second article discharging apparatus 20*b* will be described simply with illustration omitted as appropriate and with "'" attached to the symbols attached in the first article discharging apparatus 20*a* for components common to the components of the first article discharging apparatus 20*a* among the components of the second article discharging apparatus 20*b*.

The second article discharging apparatus 20*b* is used for the second article storage passage 13*b* and is arranged at the lower part of this second article storage passage 13*b*. This second article discharging apparatus 20*b* controls the behavior of articles between the second article discharging apparatus 20*b* and a passage width defining plate 17 facing it, thereby functioning to store the articles in the second article storage passage 13*b* in a discharge standby state and to discharge a corresponding article one by one to the article chute 5 when being driven and includes a base 21'.

Figure 18:
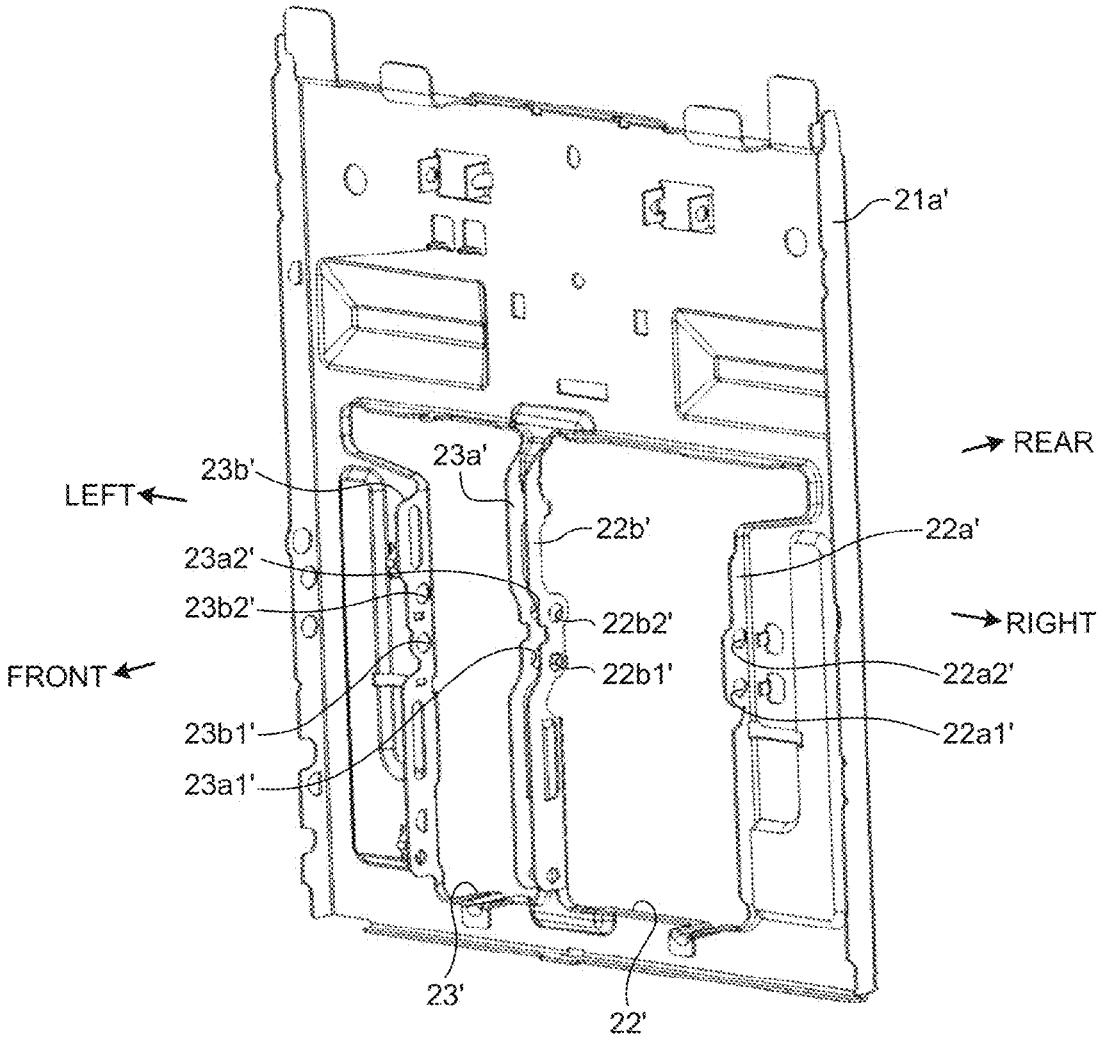
FIG. 18 is a perspective view of a base of the second article discharging apparatus illustrated in FIG. 16.

As illustrated in FIG. 18, the base 21' is formed by performing cutting and bending on a steel sheet and is arranged in such a manner as to cause its surface to face the passage width defining plate 17. This base 21' is formed with side walls 21*a*' by causing its both ends to be bent and is formed with a first insertion hole 22' and a second insertion hole 23' in its intermediate part. The peripheries of the first insertion hole 22' and the second insertion hole 23' are bent similarly to the side walls 21*a*' to form flanges.

The first insertion hole 22' and the second insertion hole 23' are formed so as to be next to each other right and left and have the same up-and-down dimension. As to the first insertion hole 22' and the second insertion hole 23', the first insertion hole 22' is positioned on the right side of the second insertion hole 23', and the right-and-left width of the first insertion hole 22' is larger than the right-and-left width of the second insertion hole 23'. The first insertion hole 22' and the second insertion hole 23' are both through openings (recesses causing a lower pedal 28' and an upper pedal 29' described below to retract to within the base 21') formed in a substantially rectangular shape as a whole; the upper end of the first insertion hole 22' protrudes rightward, whereas the upper end of the second insertion hole 23' protrudes leftward. A first right shaft support piece 22*a*' is provided on the right side edge of the first insertion hole 22', whereas a first left shaft support piece 22*b*' is provide on the left side edge of the first insertion hole 22'; a second right shaft support piece 23*a*' is provided on the right side edge of the second insertion hole 23', whereas a second left shaft support piece 23*b*' is provided on the left side edge of the second insertion hole 23'. The first left shaft support piece 22*b*' and the second right shaft support piece 23*a*' correspond to the flanges formed on the peripheries of the first insertion hole 22' and the second insertion hole 23'. The first left shaft support piece 22*b*' and the second right shaft support piece 23*a*' are formed in shaft inserting flanges forming U-shaped both leg pieces in a shaft support holding part that is formed integrally with the base 21' and is formed to have a U-shaped transverse cross section (discontinuous) that holds a shaft support part 24' described below in a fitted manner. This shaft support holding part has a function of maintaining the strength of the base 21' also when a large through opening including the first insertion hole 22' and the second insertion hole 23' formed in a substantially rectangular shape as a whole is formed in the base 21'.

Figure 19:
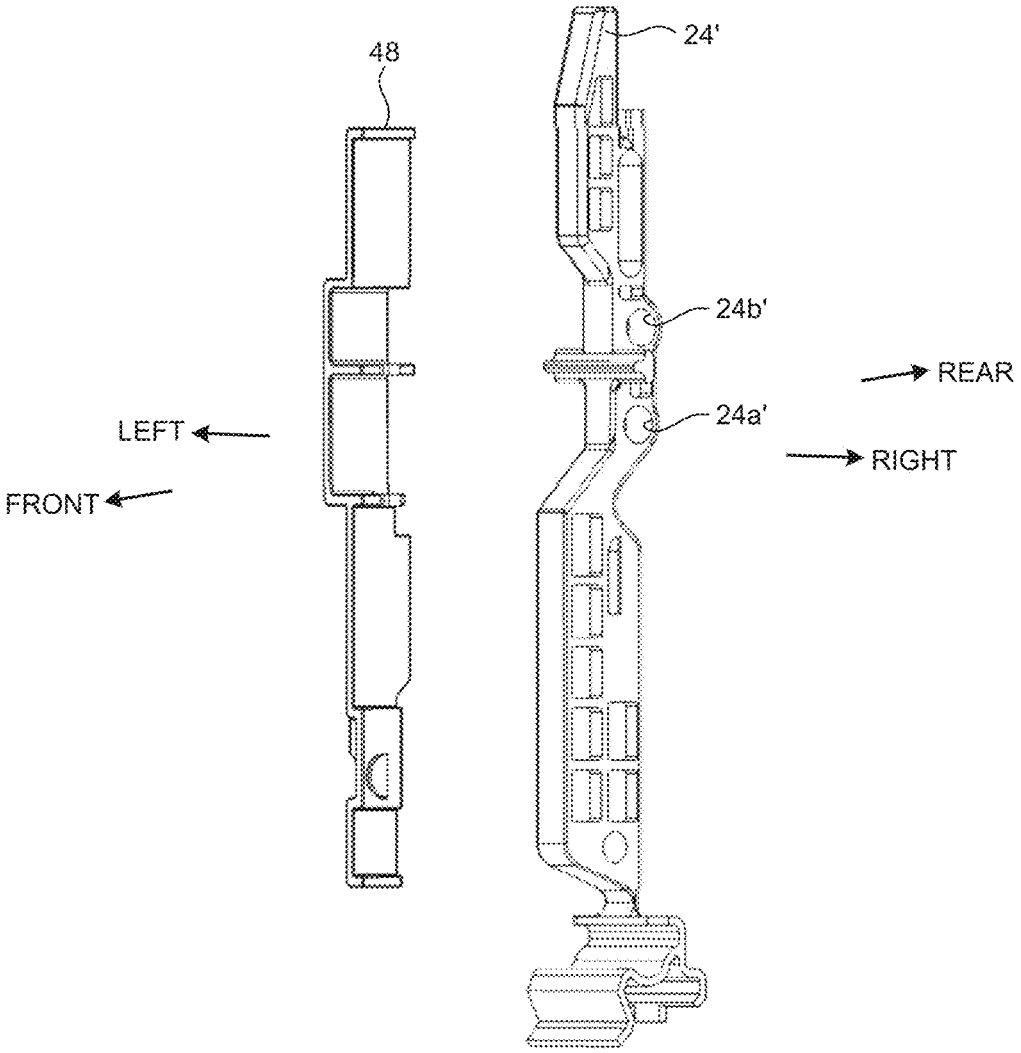
FIG. 19 is a perspective view of a shaft support part and a guide mounted on the base illustrated in FIG. 18.

The shaft support part 24' and a guide 48 as illustrated in FIG. 19 are mounted on the base 21' having the above configuration. The shaft support part 24' is formed of a resin material or the like and is fitted into between the first left shaft support piece 22*b*' and the second right shaft support piece 23*a*'. The guide 48 is formed of a resin material or the like similarly to the shaft support part 24' and is fitted to the base 21' in such a manner as to be adjacent to the second left shaft support piece 23*b*'.

Provided on the base 21' are a first swinging support shaft 28*a*' and a second swinging support shaft 29*a*'. The first swinging support shaft 28*a*' is a shaft-shaped member installed passing through open holes 22*a*1', 22*b*1', 23*a*1', 23*b*1', and 24*a*' formed in the first right shaft support piece 22*a*', the first left shaft support piece 22*b*', the second right shaft support piece 23*a*', the second left shaft support piece 23*b*', and the shaft support part 24', respectively, in such a manner as to extend in the substantially horizontal direction and supports the lower pedal 28' in its intermediate part.

A second out-of-stock link 50 is arranged at the right end of the first swinging support shaft 28*a*'. The second out-of-stock link 50 includes a second out-of-stock base and a second out-of-stock contact part, which are not illustrated, and a second out-of-stock pressing part 53 (refer to FIG. 11). The second out-of-stock base is formed by coupling lower ends of two C-shaped, disc-shaped parts by a coupling part, for example, in which open holes through which the right end of the first swinging support shaft 28*a*' is passed are formed in the respective disc-shaped members. The second out-of-stock contact part extends leftward than a forward part of the left disc-shaped part of the second out-of-stock base. This second out-of-stock contact part is provided on the left side of the first out-of-stock contact part 32 included in the first out-of-stock link 30, thereby causing them not to interfere with each other. The second out-of-stock pressing part 53 is formed so as to protrude rightward than a lower part of the right disc-shaped part of the second out-of-stock base. The open holes formed in the second out-of-stock base are formed larger than the first swinging support shaft 28*a*', thereby enabling the second out-of-stock link 50 to move freely relative to the first swinging support shaft 28*a*'.

The second swinging support shaft 29*a*' is a shaft-shaped member installed passing through open holes 22*a*2', 22*b*2',

23*a*2', 23*b*2', and 24*b*' formed in the first right shaft support piece 22*a*', the first left shaft support piece 22*b*', the second right shaft support piece 23*a*', the second left shaft support piece 23*b*', and the shaft support part 24', respectively, in such a manner as to extend in the substantially horizontal direction in an area above the first swinging support shaft 28*a*' and supports the upper pedal 29' in its intermediate part.

The lower pedal 28' is a plate-shaped member and causes the first swinging support shaft 28*a*' to be inserted into its basal end to be arranged in such a manner as to be swingable about the central axis of this first swinging support shaft 28*a*'.

A tip of the lower pedal 28' extends in the radially outside direction of the first swinging support shaft 28*a*' and can advance and retract to and from the second article storage passage 13*b* through the first insertion hole 22' and the second insertion hole 23' when the lower pedal 28' swings about the central axis of the first swinging support shaft 28*a*'. In other words, the lower pedal 28' is arranged swingably in such a manner as to advance and retract to and from the second article storage passage 13*b*.

A lower pedal spring 28*b*' is interposed between the lower pedal 28' and the base 21'. The lower pedal spring 28*b*' always biases the lower pedal 28' in an advancing direction to the second article storage passage 13*b*. More specifically, the lower pedal spring 28*b*' sets the lower pedal 28' to a standby position (hereinafter, referred to also as an article-absent standby position) so as to position the tip of the lower pedal 28' above the first swinging support shaft 28*a*' as illustrated in FIG. 17. When an article is placed on the top face of the lower pedal 28', the lower pedal spring 28*b*' sets the lower pedal 28' to a standby position (hereinafter, referred to also as an article-present standby position) so as to position the tip of the lower pedal 28' at a height level equal to the first swinging support shaft 28*a*'.

With this operation, the tip of the lower pedal 28' is positioned at an upper position when the lower pedal 28' is in the article-absent standby position than when the lower pedal 28' is at the article-present standby position.

When the lower pedal 28' is in the article-absent standby position, the basal end of the lower pedal 28' comes into contact with the second out-of-stock contact part of the second out-of-stock link 50 as illustrated in FIG. 11, whereby the second out-of-stock link 50 rotates about an axis of the first swinging support shaft 28*a*', whereby the second out-of-stock pressing part 53 presses the contact maker 27*a* of the second out-of-stock detection switch 27. With this operation, the contact maker 27*a* is pressed to be displaced rearward against the biasing force of the spring, whereby the second out-of-stock detection switch 27 is turned to the on state to send the on signal to the dispensing controller 60.

In contrast, when the lower pedal 28' is at the article-present standby position, the basal end of the lower pedal 28' separates from the second out-of-stock contact part of the second out-of-stock link 50, whereby the second out-of-stock link 50 becomes free. With this operation, the contact maker 27*a* is biased by the spring to be erected, whereby the second out-of-stock detection switch 27 is turned to the off state to send the off signal to the dispensing controller 60. In other words, the second out-of-stock pressing part 53 is pressed by the contact maker 27*a*, whereby the second out-of-stock link 50 that has become free rotates about the axis of the first swinging support shaft 28*a*'.

The lower pedal 28' includes a plate-shaped pedal main body 281' and a pair of guide parts 282'. The pair of guide parts 282' are provided on the back side of the pedal main body 281'. The guide parts 282' are plate-shaped members extending in the up-and-down direction and are formed so as to face each other. Guide grooves (not illustrated) are formed on the facing faces facing each other of the respective guide parts 282'.

The guide groove includes a fitted-in part that is positioned lowermost and in which a pedal operation shaft 361' (refer to FIG. 4) of a turning stopper 36' described below is fitted in a state in which the lower pedal 28' is arranged at an advanced position most advanced to the second article storage passage 13*b*, a contact part that is positioned uppermost and with which the pedal operation shaft 361' of the turning stopper 36' comes into contact in a state in which the lower pedal 28' is arranged at a retracted position most retracted from the second article storage passage 13*b*, and a first guide part and a second guide part that connect the fitted-in part and the contact part so as to make them continuous.

The first guide part is formed in the guide part 282' in such a manner as to incline obliquely upward so as to separate from the fitted-in part relative to the base 21', to incline obliquely upward so as to be close to the base 21', and to reach the contact part in the state in which the lower pedal 28' is arranged at a position (an advanced position) most advanced relative to the second article storage passage 13*b*.

The second guide part is formed in the guide part 282' in such a manner as to incline obliquely downward so as to separate from the contact part relative to the base 21' and to reach the fitted-in part in the state in which the lower pedal 28' is arranged at the position (the advanced position) most advanced to the second article storage passage 13*b*.

The radially outward length of this lower pedal 28' from the first swinging support shaft 28*a*' is set to a length that can ensure a gap smaller than the maximum width of an article the maximum width of which is smaller between the lower pedal 28' and the passage width defining plate 17 when the lower pedal 28' is positioned at the position (the advanced position) most advanced to the second article storage passage 13*b*.

The upper pedal 29' is a plate-shaped member and causes the second swinging support shaft 29*a*' to be inserted into its basal end to be thereby arranged on the base 21' in such a manner as to be swingable about the central axis of this second swinging support shaft 29*a*'.

A tip of the upper pedal 29' extends in the radially outside direction of the second swinging support shaft 29*a*' and can advance and retract to and from the second article storage passage 13*b* through the first insertion hole 22' and the second insertion hole 23' when the upper pedal 29' swings about the central axis of the second swinging support shaft 29*a*'. In other words, the upper pedal 29' is arranged swingably in such a manner as to advance and retract to and from the second article storage passage 13*b*.

An upper pedal spring (not illustrated) is interposed between the upper pedal 29' and the base 21'. The upper pedal spring always biases the upper pedal 29' in a retracting direction from the second article storage passage 13*b*.

The upper pedal 29' includes a pressing inclined face 291', a recess 292', a stopper contact part 293', and a protrusion 294'. The pressing inclined face 291' is provided at the tip of the upper pedal 29' and is a curved inclined face formed in such a manner as to gradually lower toward the second article storage passage 13*b* when the upper pedal 29' is retracted from the second article storage passage 13*b*. The recess 292' is provided on the back side of the upper pedal 29' and is a line of recess extending in the substantially horizontal direction formed in such a manner as to open to both side faces of the upper pedal 29'. The stopper contact part 293' is a part with which a stopper pin described below comes into contact and is provided in such a manner as to incline above the recess 292' on the back side of the upper pedal 29'.

The protrusion 294' is provided in such a manner as to protrude at the basal end of the upper pedal 29' toward the second article storage passage 13*b*.

This upper pedal 29' is biased to retract from the second article storage passage 13*b* by the biasing force of the upper pedal spring, and the stopper pin comes into contact with the recess 292', whereby an initial position is set to the state in which the upper pedal 29' has retracted from the second article storage passage 13*b*.

This upper pedal 29' is inclined forward relative to a vertical plane passing through the second swinging support shaft 29*a*' in a state in which the upper pedal 29' is positioned at a position (an advanced position) most advanced to the second article storage passage 13*b*. The radially outward length of the upper pedal 29' from the second swinging support shaft 29*a*' is set to a length that can ensure a gap smaller than the maximum width of an article the maximum width of which is smaller between the upper pedal 29' and the passage width defining plate 17 in the forward inclined state.

In the base 21', installed between the shaft support part 24' and the second left shaft support piece 23*b*' are the stopper pin (not illustrated), a pedal stopper pin 34*b*', and a stopper shaft 34*c*'.

The stopper pin is a shaft-shaped member arranged in the substantially horizontal direction between the shaft support part 24' and the second left shaft support piece 23*b*'. This stopper pin is connected to a pedal link 35' and can move in the up-and-down direction along with the movement in the up-and-down direction of the pedal link 35'. The stopper pin is in contact with the recess 292' of the upper pedal 29' in the initial position.

The pedal stopper pin 34*b*' is a shaft-shaped member arranged in the substantially horizontal direction between the shaft support part 24' and the second left shaft support piece 23*b*'. This pedal stopper pin 34*b*' is connected to a pedal link 35' and can move in the up-and-down direction along with the movement in the up-and-down direction of the pedal link 35'.

The stopper shaft 34*c*' is a shaft-shaped member arranged in the substantially horizontal direction between the shaft support part 24' and the second left shaft support piece 23*b*' and supports the turning stopper 36' in its intermediate part.

The turning stopper 36' causes the stopper shaft 34*c*' to be inserted into its insertion hole of its basal end and is arranged between the shaft support part 24' and the second left shaft support piece 23*b*' in such a manner as to be swingable about the central axis of this stopper shaft 34*c*'.

A tip of the turning stopper 36' extends in the radially outside direction of the stopper shaft 34*c*' and can advance and retract to and from the second article storage passage 13*b* through the second insertion hole 23' when the turning stopper 36' swings about the central axis of the stopper shaft 34*c*'.

This turning stopper 36' causes the pedal operation shaft 361' to be inserted into an open hole (not illustrated) of the tip and thereby has the pedal operation shaft 361'. The pedal operation shaft 361' is a shaft-shaped member arranged in the substantially horizontal direction, both ends of which are fitted in the guide grooves of the lower pedal 28'.

A pedal operation spring (not illustrated) is interposed between the turning stopper 36' and the base 21'. The pedal operation spring always biases the turning stopper 36' in an advancing direction to the second article storage passage 13*b*.

This turning stopper 36' is biased in an advancing direction to the second article storage passage 13*b* by the pedal operation spring and is prevented from moving in a retracting direction by the pedal stopper pin 34*b*' entering an indentation 36*b*' of the turning stopper 36' and coming into contact with the pedal stopper pin 34*b*', and an initial position with the turning stopper 36' advanced to the second article storage passage 13*b* is set. The lower pedal 28' is biased by the lower pedal spring 28*b*', whereby the turning stopper 36' positions both ends of the pedal operation shaft 361' at the fitted-in parts of the guide grooves and sets an initial position at a position at which the lower pedal 28' has advanced to the second article storage passage 13*b*.

The pedal link 35' is an elongated plate-shaped member extending in the up-and-down direction, in which an upper part is bent rearward and then extends upward. Provided on the upper part of this pedal link 35' are a contact piece 351' that extends frontward and then extends obliquely upward and a locking part 352' that locks a link spring 35*a*'. This link spring 35*a*' is interposed between the pedal link 35' and the base 21' and always biases the pedal link 35' downward.

With the pedal link 35' biased by the link spring 35*a*' and arranged at a lower position, the recess 292' of the upper pedal 29' arranged at the retracted position is in contact with the stopper pin. Besides, the turning stopper 36' arranged at the advanced position is in contact with the pedal stopper pin 34*b*', thereby preventing the turning stopper 36 from retracting. In addition, the pedal operation shaft 361' of the turning stopper 36' arranged at the advanced position is fitted in the fitted-in parts of the lower pedal 28', thereby preventing the lower pedal 28' arranged at the advanced position from retracting.

In contrast, with the pedal link 35' arranged at an upper position against the biasing force of the link spring 35*a*', the stopper contact part 293' of the upper pedal 29' is in contact with the stopper pin, thereby preventing the upper pedal 29' from retracting and causing the upper pedal 29' to advance against the biasing force of the upper pedal spring and to be arranged at the advanced position.

Meanwhile, the prevention of retracting for the turning stopper 36' by the pedal stopper pin 34*b*' is released, and the prevention of retracting is released about the stopper shaft 34*c*'. The load of the article in contact with the lower pedal 28' maintained at the advanced position by the turning stopper 36' is being applied to the turning stopper 36', and the prevention of retracting for the turning stopper 36' has been released, whereby the turning stopper 36' starts retracting. When the retracting of the turning stopper 36' is started, the pedal operation shaft 361' is detached from the fitted-in parts of the lower pedal 28', whereby the lower pedal 28' is allowed to retract about the first swinging support shaft 28*a*' and retracts against the elastic biasing force of the lower pedal spring 28*b*' by the load of the article.

When the lower pedal 28' thus retracts, the basal end of the lower pedal 28' separates from the second out-of-stock contact part of the second out-of-stock link 50, whereby the second out-of-stock link 50 becomes free. With this operation, the contact maker 27*a* is pressed by the spring to be erected, whereby the second out-of-stock detection switch 27 maintains the off state. In other words, also when the lower pedal 28' retracts similarly to the article-present standby position, the second out-of-stock link 50 does not press the contact maker 27*a* of the second out-of-stock detection switch 27.

The first article discharging apparatus 20*a* and the second article discharging apparatus 20*b* having the above configuration are combined in a back-to-back manner with the harness guide 25 as a guide member to form the article dispensing apparatus 20. In this case, the tip of the first link lever 461 included in the driving unit 40 is positioned at a lower area of the contact piece 351 of the pedal link 35, whereas the tip of the second link lever 462 is positioned at a lower area of the contact piece 351' of the pedal link 35'.

Figure 20:
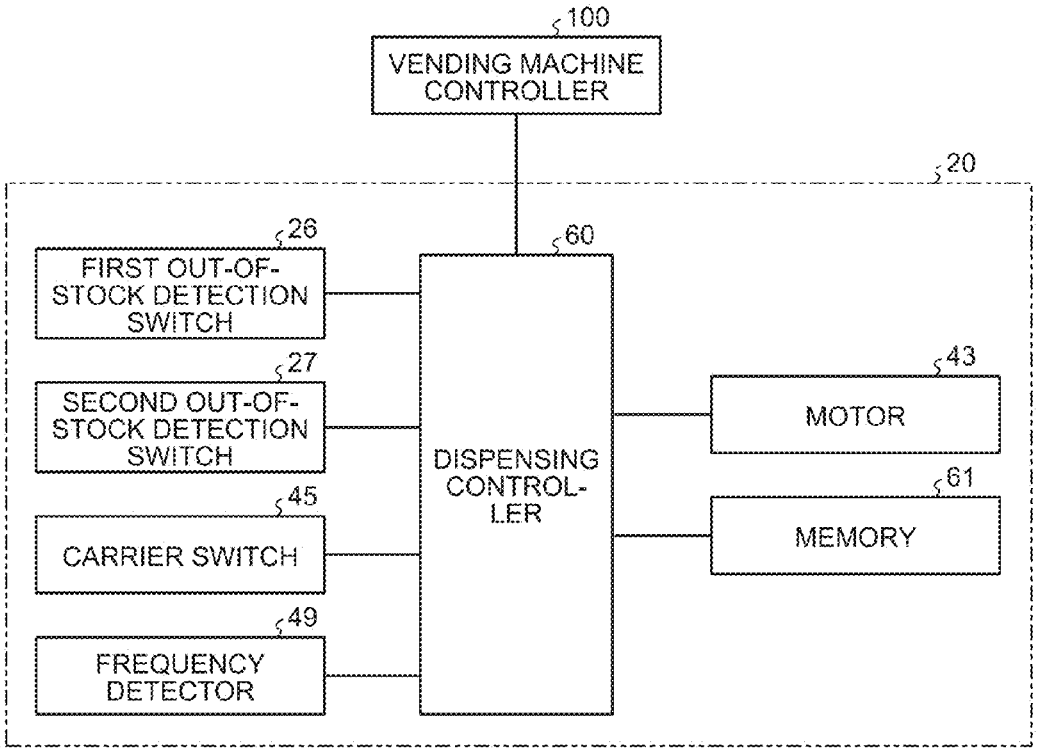
FIG. 20 is a block diagram of a characteristic control system of the article dispensing apparatus.

FIG. 20 is a block diagram of a characteristic control system of the article dispensing apparatus 20. As illustrated in FIG. 20, the article dispensing apparatus 20 includes a frequency detector 49 and the dispensing controller 60.

The frequency detector 49 detects the frequency of a power source supplied to the motor 43 and specifically detects whether a power failure has occurred.

The dispensing controller 60 comprehensively controls the operation of the article dispensing apparatus 20 in accordance with computer programs and data stored in a memory 61 and is communicable with a vending machine controller 100 that controls the selling operation of the vending machine. Processing that this dispensing controller 60 performs will be described below.

The article dispensing apparatus 20 configured as described above in the standby state is as follows.

In the driving unit 40 provided in the first article discharging apparatus 20*a*, the cam part 443*a* and the pressing piece 443*b* of the output gear 443 are positioned uppermost, and the pressing piece 443*b* is pressing the contact maker 45*a* of the carrier switch 45. In this case, the carrier switch 45 is turned to the on state. In this standby state, the tip 461*b* of the first link lever 461 included in the driving unit 40 is at a position separate from the contact piece 351 of the pedal link 35 downward, whereas the tip 462*b* of the second link lever 462 is at a position separate from the contact piece 351' of the pedal link 35' downward.

Given this situation, in the first article discharging apparatus 20*a*, the pedal link 35 is arranged at the lower position as illustrated in FIG. 5. Articles are charged into the first article storage passage 13*a*, and an article is placed on the upper face of the lower pedal 28, whereby the lower pedal 28 is at the article-present standby position, and the upper pedal 29 has retracted from the first article storage passage 13*a*. The lower pedal 28 is thus at the article-present standby position, and the contact maker 26*a* is erected, whereby the first out-of-stock detection switch 26 is turned to the off state.

In the second article discharging apparatus 20*b*, the pedal link 35' is positioned at the lower position, the lower pedal 28' is at the article-present standby position, and the upper pedal 29' has retracted from the second article storage passage 13*b*. The lower pedal 28' is thus at the article-present standby position, and the contact maker 27*a* is elected, whereby the second out-of-stock detection switch 27 is turned to the off state.

Figure 21:
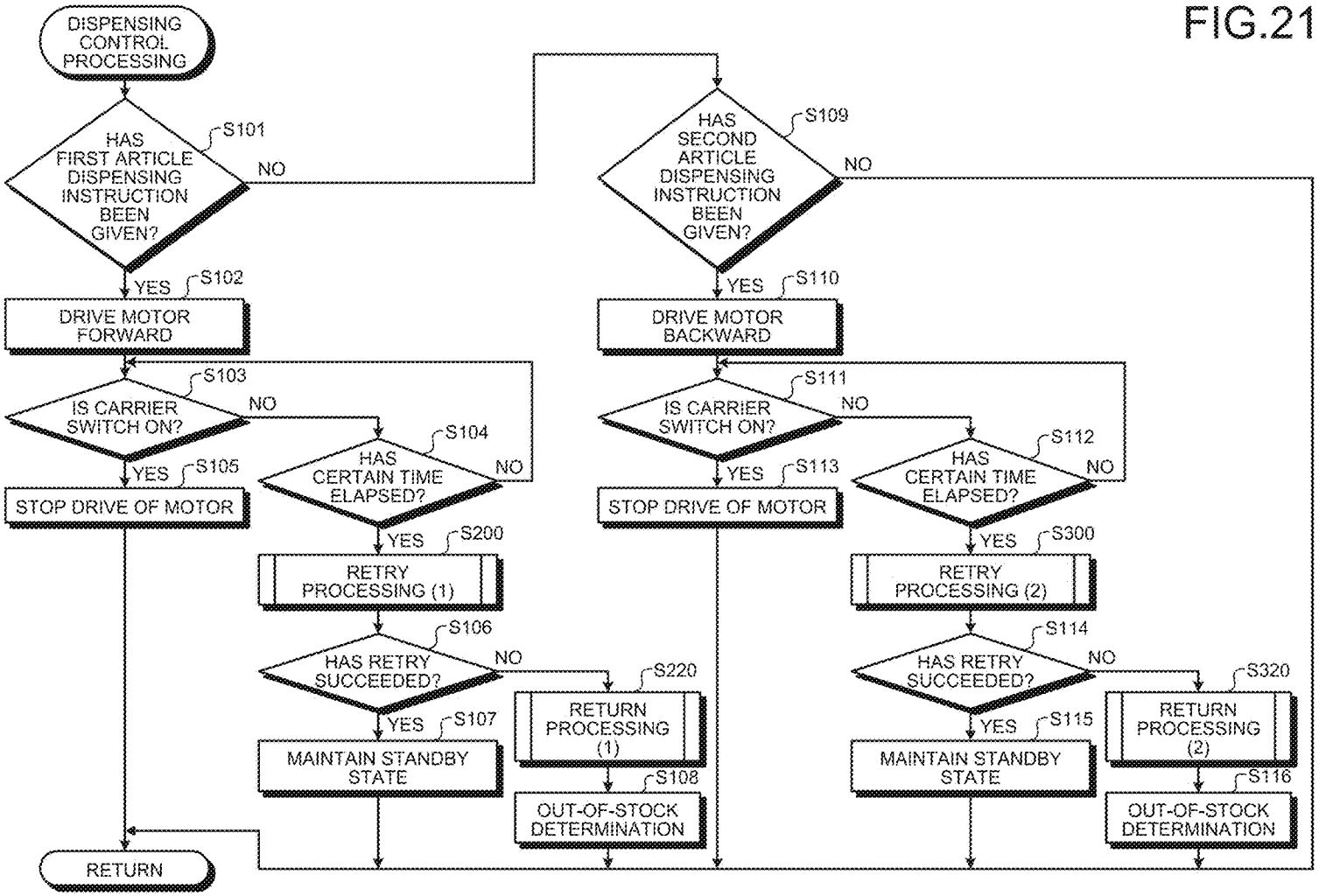
FIG. 21 is a flowchart of the processing details of dispensing control processing that a dispensing controller performs.

FIG. 21 is a flowchart of the processing details of dispensing control processing that the dispensing controller 60 performs. The following describes the operation of the article dispensing apparatus 20 while describing the dispensing control processing. In the following description, an article stored in the first article storage passage 13*a* will be referred to also as a "first article," whereas an article stored in the second article storage passage 13*b* will be referred to also as a "second article."

In the dispensing control processing, the dispensing controller 60, if a dispensing instruction (a discharging instruction) for the first article is given thereto from the vending machine controller 100 (Yes at Step S101), drives the motor 43 forward (Step S102).

When the motor 43 is thus driven forward, the output gear 443 to which the driving force of the motor 43 has been transmitted via the worm gear 441 and the intermediate gear 442 rotates clockwise when viewed from the front.

When the output gear 443 rotates clockwise when viewed from the front, the pressing piece 443*b* of the output gear 443 separates from the contact maker 45*a* of the carrier switch 45. With this operation, the contact maker 45*a* of the carrier switch 45 is released from the pressed state to be turned to the off state.

Figure 22:
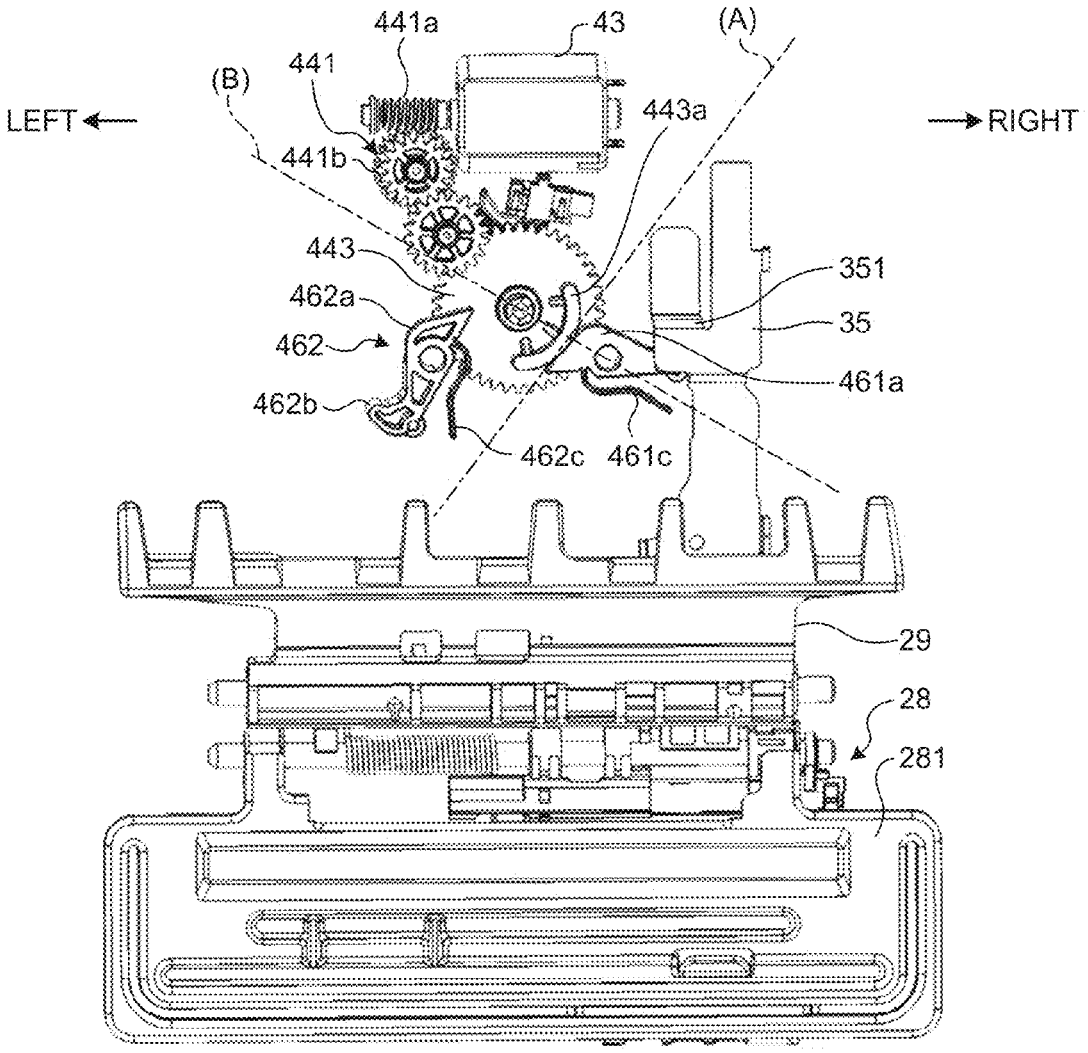
FIG. 22 is an illustrative diagram when viewing the operation of a principal part of the driving unit from the front.
Figure 23:
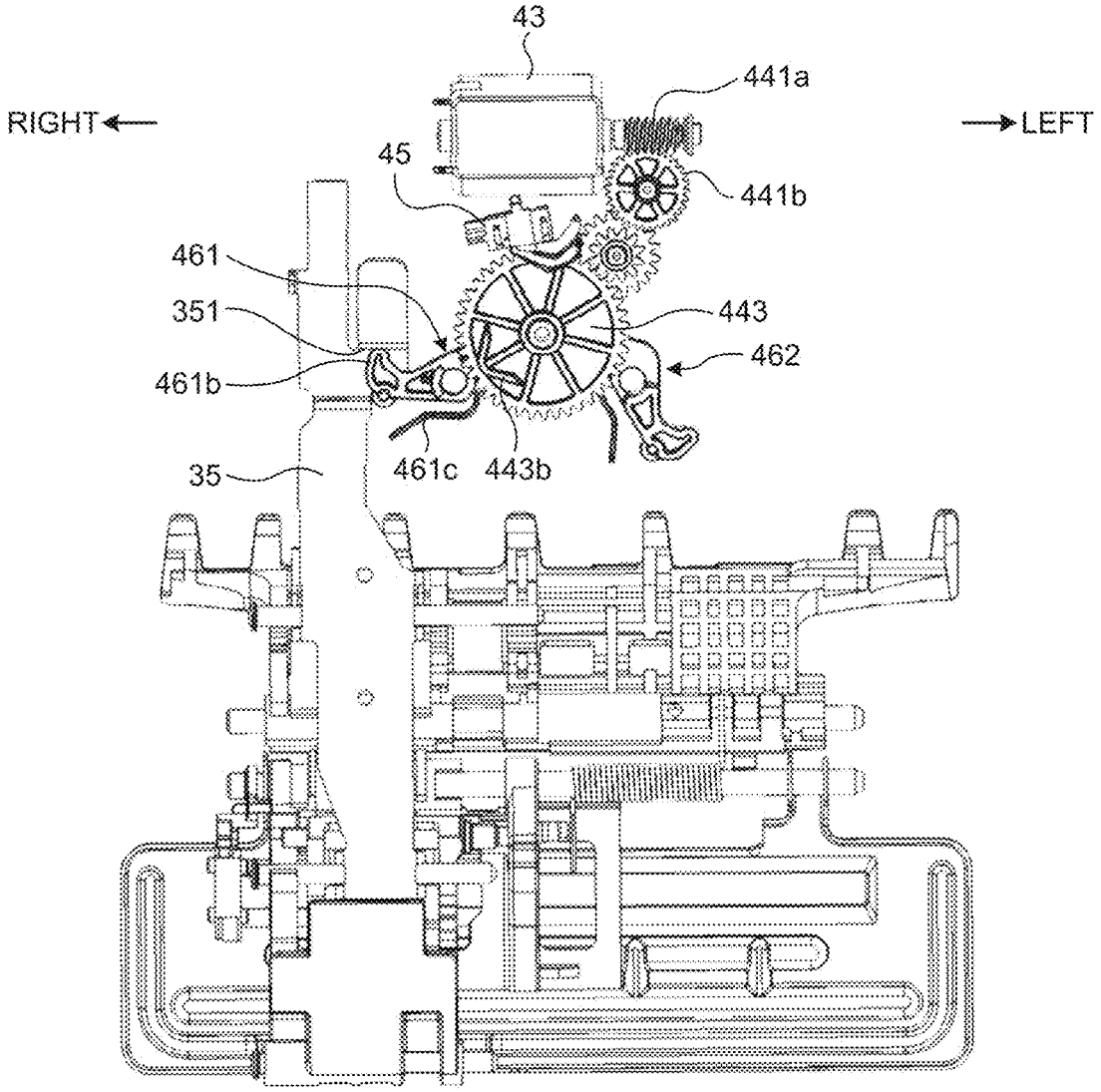
FIG. 23 is an illustrative diagram when viewing the operation of the principal part of the driving unit from the rear squarely.

When the cam part 443*a* comes into contact with the basal end 461*a* of the first link lever 461 from above by the rotation of the output gear 443, the first link lever 461 rotates counterclockwise when viewed from the front. When this first link lever 461 rotates counterclockwise, the tip 461*b* moves upward. The tip 461*b* thus moves upward to come into contact with the contact piece 351 of the pedal link 35 as illustrated in FIG. 22 and FIG. 23, can move the pedal link 35 upward by a certain distance against the biasing force of the link spring 35*a*, and can besides maintain the state in which the pedal link 35 has been moved upward by the certain distance while the cam part 443*a* is in sliding contact with the basal end 461*a*.

In this case, the first link lever 461, when being in sliding contact with the cam part 443*a*, is adjusted so as to cause a plane (A) containing a part in sliding contact with the cam part 443*a* to be substantially orthogonal to a plane (B) containing its own central axis (the central axis of the first link shaft 42*e*) and the central axis of the output gear 443.

Along with this upward movement of the pedal link 35, the stopper pin 34*a* moves upward from the lower end of the stopper pin insertion holes 23*b*3 and 24*c*1, and the pedal stopper pin 34*b* moves upward from the lower end of the pedal stopper pin support grooves 23*b*4 and 24*c*2.

In this process, the stopper pin 34*a* moves upward while being in contact with the edge wall of the recess 292 of the upper pedal 29, whereby the upper pedal 29 advances from the initial position against the biasing force of the upper pedal spring. This advancing of the upper pedal 29 is performed by the upward movement of the stopper pin 34*a*. When reaching the upper end of the stopper pin insertion holes 23*b*3 and 24*c*1, the stopper pin 34*a* comes into contact with the stopper contact part 293 to prevent the upper pedal 29 from retracting.

The upper pedal 29 that has advanced comes into contact with the second lowermost first article (hereinafter, referred to also as a next article) to prevent the next article from moving downward.

Meanwhile, the load of the article in contact with the lower pedal 28 maintained at the advanced position is being applied to the turning stopper 36, and the prevention of retracting has been released by the upward movement of the pedal stopper pin 34*b*, whereby the turning stopper 36 starts retracting.

When the turning stopper 36 thus starts retracting, the pedal operation shaft 361 escapes from the fitted-in part 283*a*, and the lower pedal 28 starts retracting against the biasing force of the lower pedal spring 28*b* by the self-weight of the article. The pedal operation shaft 361 of the turning stopper 36 that has escaped from the fitted-in part 283*a* moves toward a position at which the first guide part 283*b* and the second guide part 283*c* cross each other along the first guide part 283*b*.

After that, the lower pedal 28 retracts by the self-weight of the lowermost article, the lowermost article is allowed to move downward, and the lowermost article is discharged downward (refer to FIG. 8). The discharged article is guided to the article discharging port 3*c* via the article chute 5 and is further enabled to be taken out via the article outlet port 2*a*.

When the lowermost article slips through the lower pedal 28, the lower pedal 28 moves toward the advanced position by the elastic biasing force of the lower pedal spring 28*b*, and the turning stopper 36 also moves toward the advanced position by the elastic biasing force of the pedal operation spring. When the lower pedal 28 and the turning stopper 36 move toward the advanced position, the pedal operation shaft 361 that has been maintained at the position at which the first guide part 283*b* and the second guide part 283*c* cross each other moves toward the fitted-in part 283*a* along the second guide part 283*c*, and the lower pedal 28 and the turning stopper 36 return to the advanced position.

Meanwhile, the pedal link 35 moves upward, the stopper pin 34*a* is positioned at the upper end of the stopper pin insertion holes 23*b*3 and 24*c*1, and the pedal stopper pin 34*b* is positioned at the upper end of the pedal stopper pin support grooves 23*b*4 and 24*c*2.

After that, when the contact between the cam part 443*a* and the basal end 462*a* is released by the rotation of the output gear 443, the pedal link 35 is biased by the link spring 35*a* to move downward.

By this downward movement of the pedal link 35, the stopper pin 34*a* moves downward from the upper end of the stopper pin insertion holes 23*b*3 and 24*c*1, and the pedal stopper pin 34*b* moves downward from the upper end of the pedal stopper pin support grooves 23*b*4 and 24*c*2.

When the pedal stopper pin 34*b* moves to the lower end of the pedal stopper pin support grooves 23*b*4 and 24*c*2, the pedal stopper pin 34*b* comes into contact with the indentation 36*b* on the back side of the turning stopper 36 that has returned to the advanced position. With this operation, movement in the retracting direction is prevented, and the lower pedal 28 returns to the article-absent standby position that has advanced to the first article storage passage 13*a* by the biasing force of the lower pedal spring 28*b*.

Meanwhile, the upper pedal 29 retracts along with the downward movement of the stopper pin 34*a* by being biased by the upper pedal spring. With this operation, the next article is allowed to move downward, and while the next article then comes into contact with the lower pedal 28 having advanced and is prevented from moving downward, the lower pedal 28 shifts to the article-present standby position and returns to the standby state.

In the driving unit 40, by the clockwise rotation when viewed from the front of the output gear 443, the cam part 443*a* then comes into contact with the basal end 462*a* of the second link lever 462. In this case, the locking part 462*c* is in contact with the right side edge 472 of the left opening, whereby the second link lever 462 is prevented from rotating about the central axis. Consequently, the locking part 462*c* becomes elastically deformed so as to allow the basal end 462*a* to be close to the locking part 462*c*, and the movement of the cam part 443*a* by the rotation of the output gear 443 is not hindered.

After that, when the cam part 443*a* returns to the standby position by the rotation of the output gear 443, the pressing piece 443*b* presses the contact maker 45*a* of the carrier switch 45, whereby the carrier switch 45 is turned to the on state. Immediately after the pressing piece 443*b* presses the contact maker 45*a* of the carrier switch 45, the cam part 443*a* is detached from the basal end 462*a* of the second link lever 462, and the second link lever 462 returns to the original state by the locking part 462*c*.

In the forward drive of the motor 43 at Step S102 as described above, the dispensing controller 60 monitors whether the carrier switch 45 is turned to the on state in a certain time (Step S103, Step S104). In other word, the dispensing controller 60 monitors whether the output gear 443 rotates by one rotation in the certain time.

As a result of this monitoring, if the carrier switch 45 is turned to the on state in the certain time (Yes at Step S103, No at Step S104), the dispensing controller 60 stops the forward drive of the motor 43 (Step S105) and returns the procedure to end the present processing. With this operation, the first article for which the dispensing instruction has been given as described above can be favorably discharged.

If the carrier switch 45 is not turned to the on state in the certain time, that is, if the on signal is not given from the carrier switch 45 in the certain time (No at Step S103, Yes at Step S104), the dispensing controller 60 performs Retry Processing (1) (Step S200).

Figure 24:
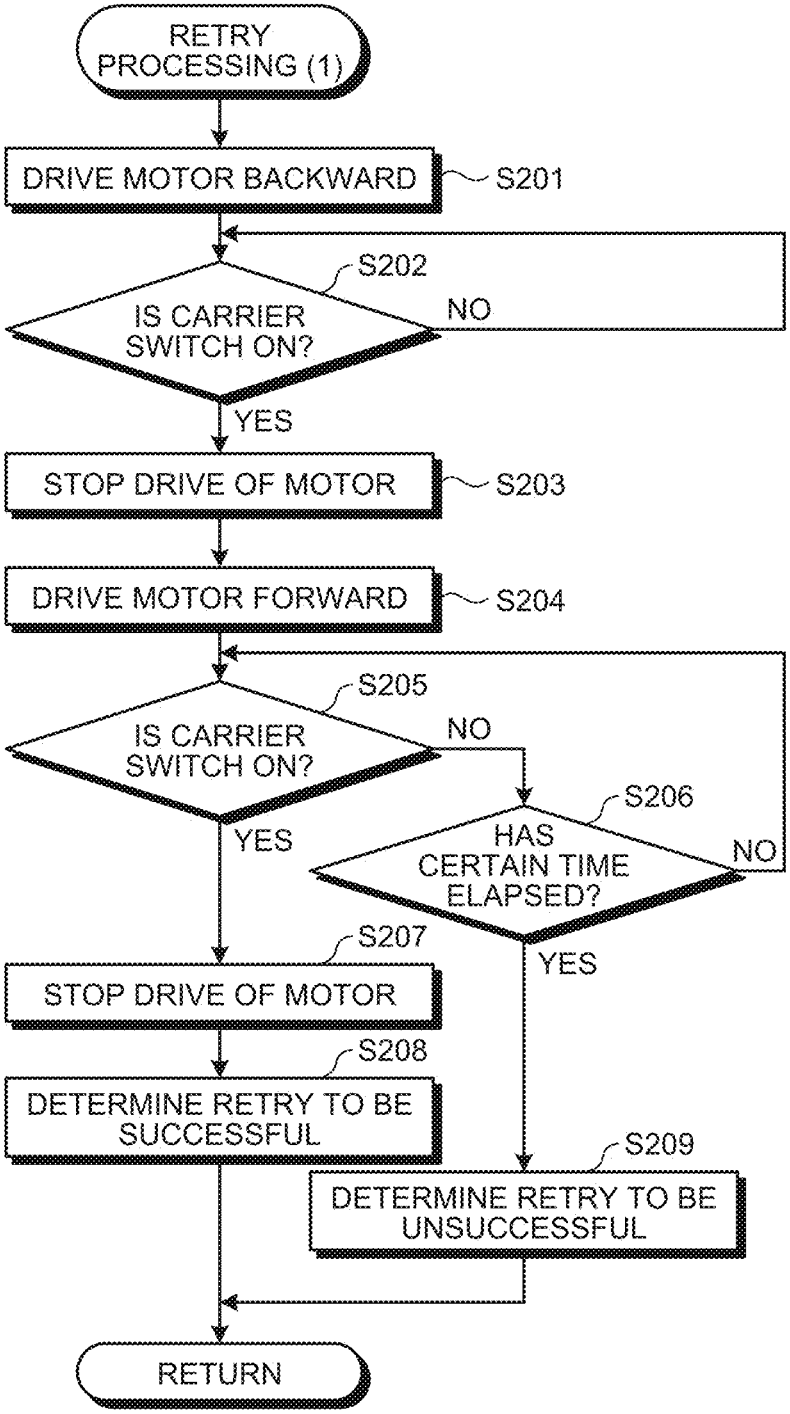
FIG. 24 is a flowchart of the processing details of Retry Processing (1) in the dispensing control processing illustrated in FIG. 21.

FIG. 24 is a flowchart of the processing details of Retry Processing (1) in the dispensing control processing illustrated in FIG. 21.

In this Retry Processing (1), the dispensing controller 60 drives the motor 43 backward and monitors whether the carrier switch 45 is turned to the on state (Step S201, Step S202). When the motor 43 is thus driven backward, the output gear 443 to which the driving force of the motor 43 has been transmitted via the worm gear 441 and the intermediate gear 442 rotates counterclockwise when viewed from the front. When the motor 43 is driven backward, at least the cam part 443*a* of the output gear 443 comes into contact with the basal end 462*a* of the second link lever 462, that is, the cam part 443*a* does not pass by the basal end 462*a*, and even when the motor 43 is driven backward, any adverse effect (discharging the second article from the second article discharging apparatus 20*b*) is not given to the second link lever 462.

As a result of this monitoring, if the carrier switch 45 is turned to the on state (Yes at Step S202), the dispensing controller 60 stops the backward drive of the motor 43 (Step S203) and drives the motor 43 forward again (Step S204). The dispensing controller 60 then monitors whether the carrier switch 45 is turned to the on state in a certain time (Step S205, Step S206).

After that, if the carrier switch 45 is turned to the on state in the certain time (Yes at Step S205, No at Step S206), that is, if the output gear 443 rotates in the certain time by one rotation clockwise when viewed from the front, it is determined that the first article has been discharged as described above, and after the drive of the motor 43 is stopped, it is determined that the retry has succeeded (Step S207, Step S208). After that, the procedure is returned to end the present Retry Processing (1).

In contrast, if the carrier switch 45 is not turned to the on state in the certain time (No at Step S205, Yes at Step S206), the dispensing controller 60 determines that a fault is occurring and that the retry has failed (Step S209) and then returns the procedure to end the present Retry Processing (1).

The dispensing controller 60 that has performed this Retry Processing (1), if the retry has succeeded (Yes at Step S106), maintains the standby state in which the output gear 443 is positioned at the standby position (Step S107) and then returns the procedure to end the present dispensing control processing. With this processing, a dispensing instruction for a new first article is given, thereby enabling the first article to be dispensed.

In contrast, if the retry has failed (No at Step S106), the dispensing controller 60 performs Return Processing (1) (Step S220).

Figure 25:
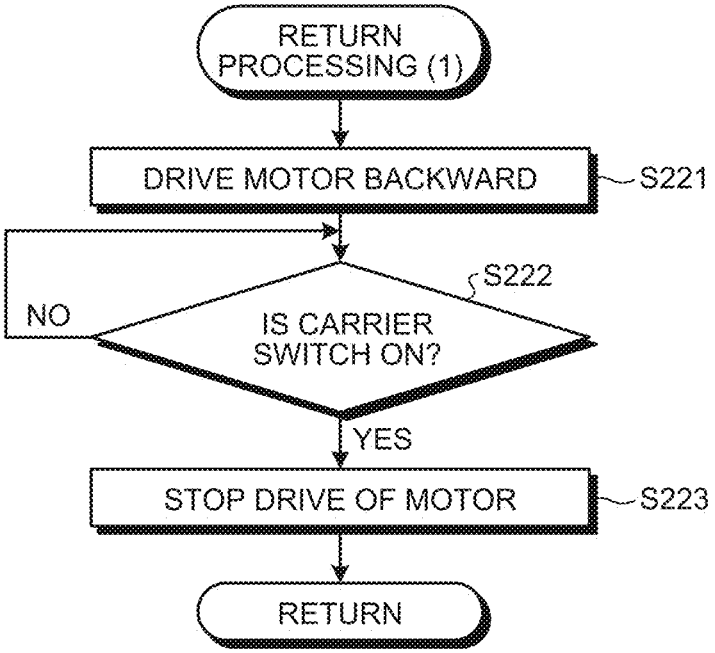
FIG. 25 is a flowchart of the processing details of Return Processing (1) in the dispensing control processing illustrated in FIG. 21.

FIG. 25 is a flowchart of the processing details of Return Processing (1) in the dispensing control processing illustrated in FIG. 21.

In this Return Processing (1), the dispensing controller 60 drives the motor 43 backward and monitors whether the carrier switch 45 is turned to the on state (Step S221, Step S222). When the motor 43 is thus driven backward, the output gear 443 to which the driving force of the motor 43 has been transmitted via the worm gear 441 and the intermediate gear 442 rotates counterclockwise when viewed from the front. When the motor 43 is driven backward, at least the cam part 443*a* of the output gear 443 comes into contact with the basal end 462*a* of the second link lever 462, that is, the cam part 443*a* does not pass by the basal end 462*a*, and even when the motor 43 is driven backward, any adverse effect (discharging the second article from the second article discharging apparatus 20*b*) is not given to the second link lever 462.

As a result of this monitoring, if the carrier switch 45 is turned to the on state (Yes at Step S222), the dispensing controller 60 stops the backward drive of the motor 43 (Step S223) and then returns the procedure to end the present Return Processing (1). With this processing, the output gear 443 is positioned at the standby position.

The dispensing controller 60 that has performed this Return Processing (1) determines that the first article in the first article storage passage 13*a* has been out of stock to perform out-of-stock determination (Step S108) and then returns the procedure to end the present processing. With this processing, it is determined that the first article has been out of stock, an out-of-stock lamp or the like is lit, and the sales of the first article can be suspended.

In contrast, the dispensing controller 60, if a dispensing instruction (a discharging instruction) for the second article is given thereto from the vending machine controller 100 (No at Step S101, Yes at Step S109), drives the motor 43 backward (Step S110).

When the motor 43 is thus driven backward, the output gear 443 to which the driving force of the motor 43 has been transmitted via the worm gear 441 and the intermediate gear 442 rotates counterclockwise when viewed from the front.

When the output gear 443 rotates counterclockwise when viewed from the front, the pressing piece 443*b* of the output gear 443 separates from the contact maker 45*a* of the carrier switch 45. With this operation, the contact maker 45*a* of the carrier switch 45 is released from the pressed state to be turned to the off state.

When the cam part 443*a* comes into contact with the basal end 462*a* of the second link lever 462 from above by the rotation of the output gear 443, the second link lever 462 rotates clockwise when viewed from the front. When this second link lever 462 rotates clockwise, the tip 462*b* moves upward. The tip 462*b* thus moves upward to come into contact with the contact piece 351' of the pedal link 35', can move the pedal link 35' upward by a certain distance against the biasing force of the link spring 35*a*', and can besides maintain the state in which the pedal link 35' has been moved upward by the certain distance while the cam part 443*a* is in sliding contact with the basal end 462*a*.

In this case, the second link lever 462, when being in sliding contact with the cam part 443*a*, is adjusted so as to cause a plane containing a part in sliding contact with the cam part 443*a* to be substantially orthogonal to a plane containing its own central axis (the central axis of the second link shaft 42*f*) and the central axis of the output gear 443, although not explicitly illustrated in the drawing.

Along with this upward movement of the pedal link 35', the stopper pin moves upward, and the pedal stopper pin 34*b*' also moves upward.

In this process, the stopper pin moves upward while being in contact with the edge wall of the recess 292' of the upper pedal 29', whereby the upper pedal 29' advances from the initial position against the biasing force of the upper pedal spring. This advancing of the upper pedal 29' is performed by the upward movement of the stopper pin. When reaching the upper end of the stopper pin insertion holes, the stopper pin comes into contact with the stopper contact part 293' to prevent the upper pedal 29' from retracting.

The upper pedal 29' that has advanced comes into contact with the second lowermost second article (hereinafter, referred to also as a next article) to prevent the next article from moving downward.

Meanwhile, the load of the article in contact with the lower pedal 28' maintained at the advanced position is being applied to the turning stopper 36', and the prevention of retracting has been released by the upward movement of the pedal stopper pin 34*b*', whereby the turning stopper 36' starts retracting.

When the turning stopper 36' thus starts retracting, the pedal operation shaft 361' escapes from the fitted-in part, and the lower pedal 28' starts retracting against the biasing force of the lower pedal spring 28*b*' by the self-weight of the article. The pedal operation shaft 361' of the turning stopper 36' that has escaped from the fitted-in part moves toward a position at which the first guide part and the second guide part cross each other along the first guide part.

After that, the lower pedal 28' retracts by the self-weight of the lowermost article, the lowermost article is allowed to move downward, and the lowermost article is discharged downward. The discharged article is guided to the article discharging port 3*c* via the article chute 5 and is further enabled to be taken out via the article outlet port 2*a*.

When the lowermost article slips through the lower pedal 28', the lower pedal 28' moves toward the advanced position by the elastic biasing force of the lower pedal spring 28*b*', and the turning stopper 36' also moves toward the advanced position by the elastic biasing force of the pedal operation spring. When the lower pedal 28' and the turning stopper 36' move toward the advanced position, the pedal operation shaft 361' that has been maintained at the position at which the first guide part and the second guide part cross each other moves toward the fitted-in part along the second guide part, and the lower pedal 28' and the turning stopper 36' return to the advanced position.

After that, when the contact between the cam part 443*a* and the basal end 462*a* is released by the rotation of the output gear 443, the pedal link 35' is biased by the link spring 35*a*' to move downward.

By this downward movement of the pedal link 35', the stopper pin moves downward, and the pedal stopper pin 34*b*' also moves downward.

When the pedal stopper pin 34*b*' moves to the lower end of the pedal stopper pin support grooves, the pedal stopper pin 34*b*' comes into contact with the indentation 36*b*' on the back side of the turning stopper 36' that has returned to the advanced position. With this operation, movement in the retracting direction is prevented, and the lower pedal 28' returns to the article-absent standby position that has advanced to the second article storage passage 13*b* by the biasing force of the lower pedal spring 28*b'*.

Meanwhile, the upper pedal 29' retracts along with the downward movement of the stopper pin by being biased by the upper pedal spring. With this operation, the next article is allowed to move downward, and while the next article then comes into contact with the lower pedal 28' having advanced and is prevented from moving downward, the lower pedal 28' shifts to the article-present standby position and returns to the standby state.

In the driving unit 40, by the counterclockwise rotation when viewed from the front of the output gear 443, the cam part 443*a* then comes into contact with the basal end 461*a* of the first link lever 461. In this case, the locking part 461*c* is in contact with the left side edge 471 of the right opening, whereby the first link lever 461 is prevented from rotating about the central axis. Consequently, the locking part 461*c* becomes elastically deformed so as to allow the basal end 461*a* to be close to the locking part 461*c*, and the movement of the cam part 443*a* by the rotation of the output gear 443 is not hindered.

After that, when the cam part 443*a* returns to the standby position by the rotation of the output gear 443, the pressing piece 443*b* presses the contact maker 45*a* of the carrier switch 45, whereby the carrier switch 45 is turned to the on state.

In the backward drive of the motor 43 at Step S110 as described above, the dispensing controller 60 monitors whether the carrier switch 45 is turned to the on state in a certain time (Step S111, Step S112). In other word, the dispensing controller 60 monitors whether the output gear 443 rotates by one rotation in the certain time.

As a result of this monitoring, if the carrier switch 45 is turned to the on state in the certain time (Yes at Step S111, No at Step S112), the dispensing controller 60 stops the backward drive of the motor 43 (Step S113) and returns the procedure to end the present processing. With this operation, the second article for which the dispensing instruction has been given as described above can be favorably discharged.

If the carrier switch 45 is not turned to the on state in the certain time, that is, if the on signal is not given from the carrier switch 45 in the certain time (No at Step S111, Yes at Step S112), the dispensing controller 60 performs Retry Processing (2) (Step S300).

Figure 26:
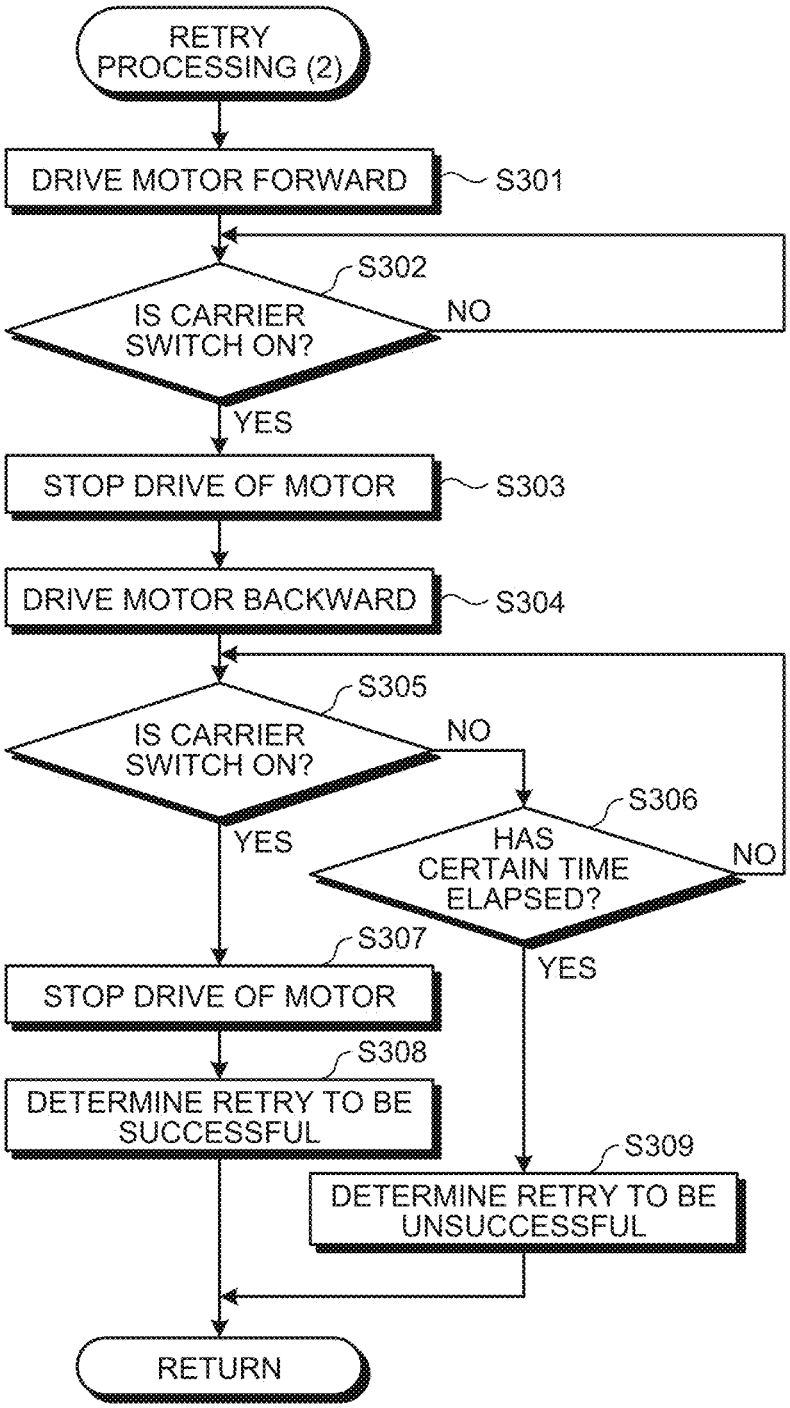
FIG. 26 is a flowchart of the processing details of Retry Processing (2) in the dispensing control processing illustrated in FIG. 21.

FIG. 26 is a flowchart of the processing details of Retry Processing (2) in the dispensing control processing illustrated in FIG. 21.

In this Retry Processing (2), the dispensing controller 60 drives the motor 43 forward and monitors whether the carrier switch 45 is turned to the on state (Step S301, Step S302). When the motor 43 is thus driven forward, the output gear 443 to which the driving force of the motor 43 has been transmitted via the worm gear 441 and the intermediate gear 442 rotates clockwise when viewed from the front.

As a result of this monitoring, if the carrier switch 45 is turned to the on state (Yes at Step S302), the dispensing controller 60 stops the forward drive of the motor 43 (Step S303) and drives the motor 43 backward again (Step S304). The dispensing controller 60 then monitors whether the carrier switch 45 is turned to the on state in a certain time (Step S305, Step S306).

After that, if the carrier switch 45 is turned to the on state in the certain time (Yes at Step S305, No at Step S306), that is, if the output gear 443 rotates in the certain time by one rotation counterclockwise when viewed from the front, it is determined that the second article has been discharged as described above, and after the drive of the motor 43 is stopped, it is determined that the retry has succeeded (Step S307, Step S308). After that, the procedure is returned to end the present Retry Processing (2).

In contrast, if the carrier switch 45 is not turned to the on state in the certain time (No at Step S305, Yes at Step S306), the dispensing controller 60 determines that a fault is occurring and that the retry has failed (Step S309) and then returns the procedure to end the present Retry Processing (2).

The dispensing controller 60 that has performed this Retry Processing (2), if the retry has succeeded (Yes at Step S114), maintains the standby state in which the output gear 443 is positioned at the standby position (Step S115) and then returns the procedure to end the present dispensing control processing. With this processing, a dispensing instruction for a new second article is given, thereby enabling the second article to be dispensed.

In contrast, if the retry has failed (No at Step S114), the dispensing controller 60 performs Return Processing (2) (Step S320).

Figure 27:
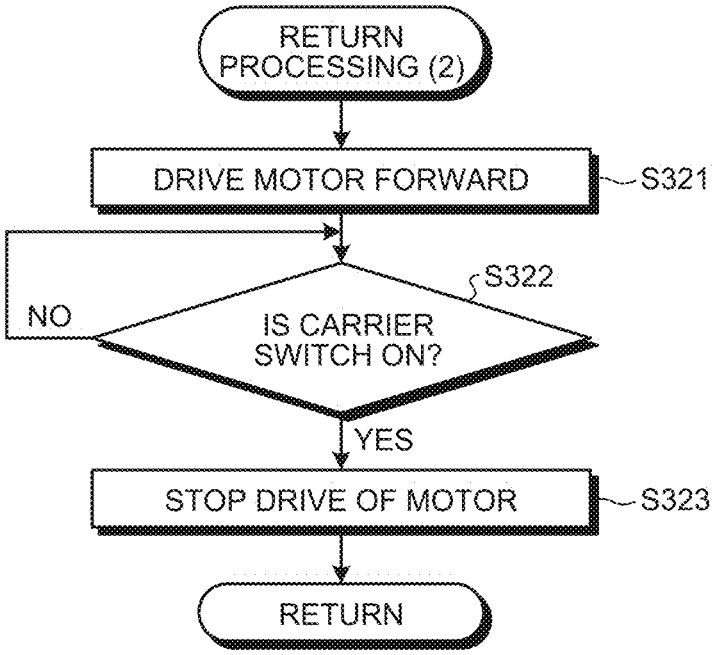
FIG. 27 is a flowchart of the processing details of Return Processing (2) in the dispensing control processing illustrated in FIG. 21.

FIG. 27 is a flowchart of the processing details of Return Processing (2) in the dispensing control processing illustrated in FIG. 21.

In this Return Processing (2), the dispensing controller 60 drives the motor 43 forward and monitors whether the carrier switch 45 is turned to the on state (Step S321, Step S322). When the motor 43 is thus driven forward, the output gear 443 to which the driving force of the motor 43 has been transmitted via the worm gear 441 and the intermediate gear 442 rotates clockwise when viewed from the front.

As a result of this monitoring, if the carrier switch 45 is turned to the on state (Yes at Step S322), the dispensing controller 60 stops the forward drive of the motor 43 (Step S323) and then returns the procedure to end the present Return Processing (2). With this processing, the output gear 443 is positioned at the standby position.

The dispensing controller 60 that has performed this Return Processing (2) determines that the second article in the second article storage passage 13*b* has been out of stock to perform out-of-stock determination (Step S116) and then returns the procedure to end the present processing. With this processing, it is determined that the second article has been out of stock, an out-of-stock lamp or the like is lit, and the sales of the second article can be suspended.

When the article becomes out of stock in the first article storage passage 13*a*, for example, the lower pedal 28 of the first article discharging apparatus 20*a* is biased by the lower pedal spring 28*b* to be at the article-absent standby position. In this case, as illustrated in FIG. 11, the basal end of the lower pedal 28 comes into contact with the first out-of-stock contact part 32 of the first out-of-stock link 30, whereby the first out-of-stock link 30 rotates about the axis of the first swinging support shaft 28*a*, whereby the first out-of-stock pressing part 33 presses the contact maker 26*a* of the first out-of-stock detection switch 26. With this operation, the contact maker 26*a* is pressed to be displaced frontward against the biasing force of the spring, whereby the first out-of-stock detection switch 26 is turned to the on state to send the on signal to the dispensing controller 60. With this processing, the dispensing controller 60 determines that the first article has been out of stock and can light an out-of-stock lamp or the like.

Next, when the article becomes out of stock in the second article storage passage 13*b*, for example, the basal end of the lower pedal 28' comes into contact with the second out-of-stock contact part of the second out-of-stock link 50, whereby the second out-of-stock link 50 rotates about the axis of the first swinging support shaft 28*a*', whereby the second out-of-stock pressing part 53 presses the contact maker 27*a* of the second out-of-stock detection switch 27. With this operation, the contact maker 27*a* is pressed to be displaced rearward against the biasing force of the spring, whereby the second out-of-stock detection switch 27 is turned to the on state to send the on signal to the dispensing controller 60. With this processing, the dispensing controller 60 determines that the second article has been out of stock and can light an out-of-stock lamp or the like.

The dispensing controller 60 is preferably configured to determine that the article has been out of stock when the on signal of the first out-of-stock detection switch 26 or the second out-of-stock detection switch 27 continues for a certain time or more. With this processing, malfunctions by chattering when the lower pedal 28 (28') returns to the article-absent standby position on each sale or caused by bounds and the like when the lower pedal 28 returns thereto can be prevented.

Figure 28:
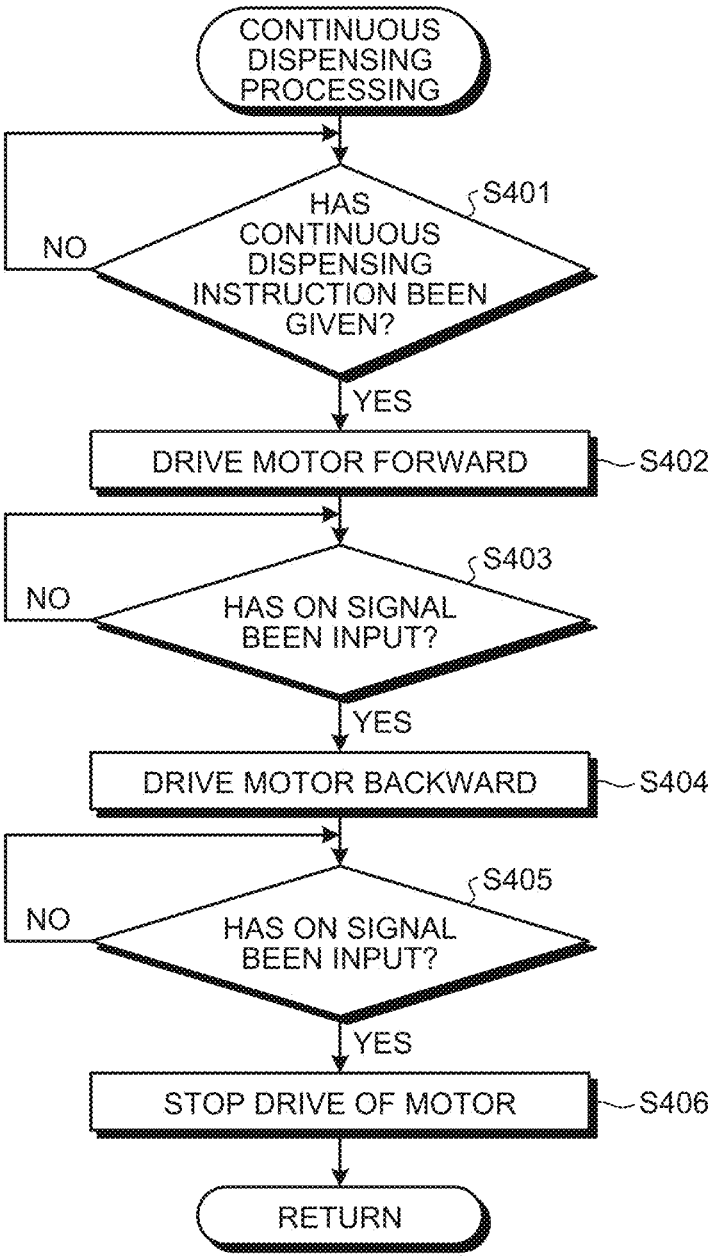
FIG. 28 is a flowchart of the processing details of continuous dispensing processing that the dispensing controller illustrated in FIG. 20 performs.

FIG. 28 is a flowchart of the processing details of continuous dispensing processing that the dispensing controller 60 performs.

In this continuous dispensing processing, the dispensing controller 60, if a continuous dispensing instruction is given thereto from the vending machine controller 100 (Yes at Step S401), drives the motor 43 forward until an on signal is input from the first out-of-stock detection switch 26 (Step S402, No at Step S403). In other words, the dispensing controller 60 repeats the dispensing control processing until the first out-of-stock detection switch 26 is turned to the on state.

The dispensing controller 60, if the on signal is input thereto from the first out-of-stock detection switch 26 (Yes at Step S403), drives the motor 43 backward until an on signal is input from the second out-of-stock detection switch 27 (Step S404, No at Step S405). In other words, the dispensing controller 60 repeats the dispensing control processing until the second out-of-stock detection switch 27 is turned to the on state.

After that, the dispensing controller 60, if the on signal is input thereto from the second out-of-stock detection switch 27 (Yes at Step S405), stops the drive of the motor 43 (Step S406) and then returns the procedure to end the present continuous dispensing processing. With this processing, first articles in the first article storage passage 13*a* and second articles in the second article storage passage 13*b* can all be dispensed continuously.

Figure 29:
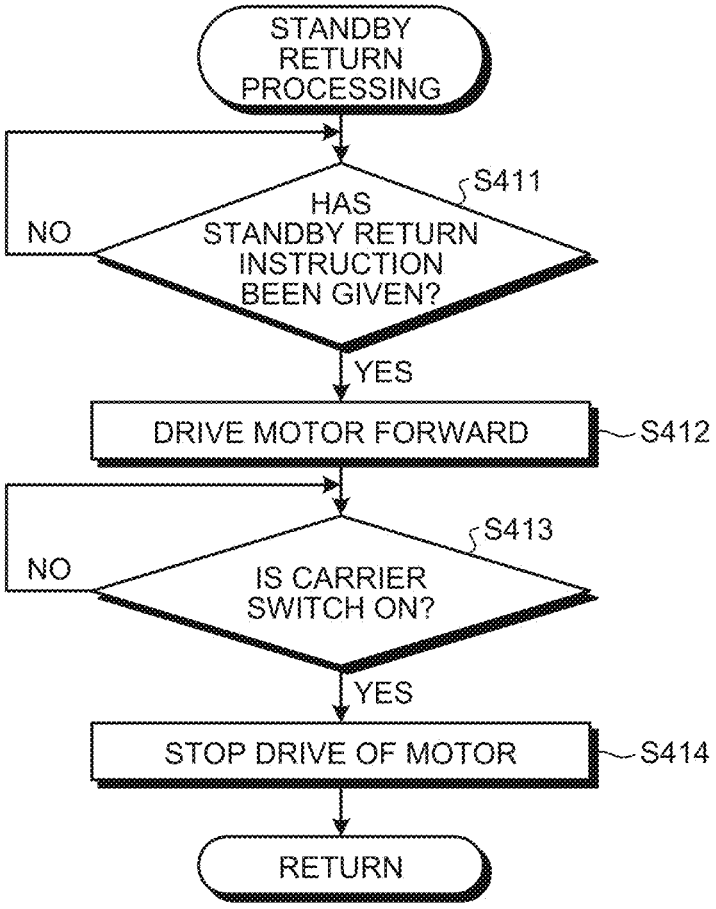
FIG. 29 is a flowchart of the processing details of standby return processing that the dispensing controller illustrated in FIG. 20 performs.

FIG. 29 is a flowchart of the processing details of standby return processing that the dispensing controller 60 performs.

In this standby return processing, the dispensing controller 60, if a standby return instruction is given thereto from the vending machine controller 100 (Yes at Step S411), drives the motor 43 forward and monitors whether the carrier switch 45 is turned to the on state (Step S412, Step S413). When the motor 43 is thus driven forward, the output gear 443 to which the driving force of the motor 43 has been transmitted via the worm gear 441 and the intermediate gear 442 rotates clockwise when viewed from the front.

As a result of this monitoring, if the carrier switch 45 is turned to the on state (Yes at Step S413), the dispensing controller 60 stops the forward drive of the motor 43 (Step S414) and then returns the procedure to end the present standby return processing. With this processing, the output gear 443 is positioned at the standby position.

Figure 30:
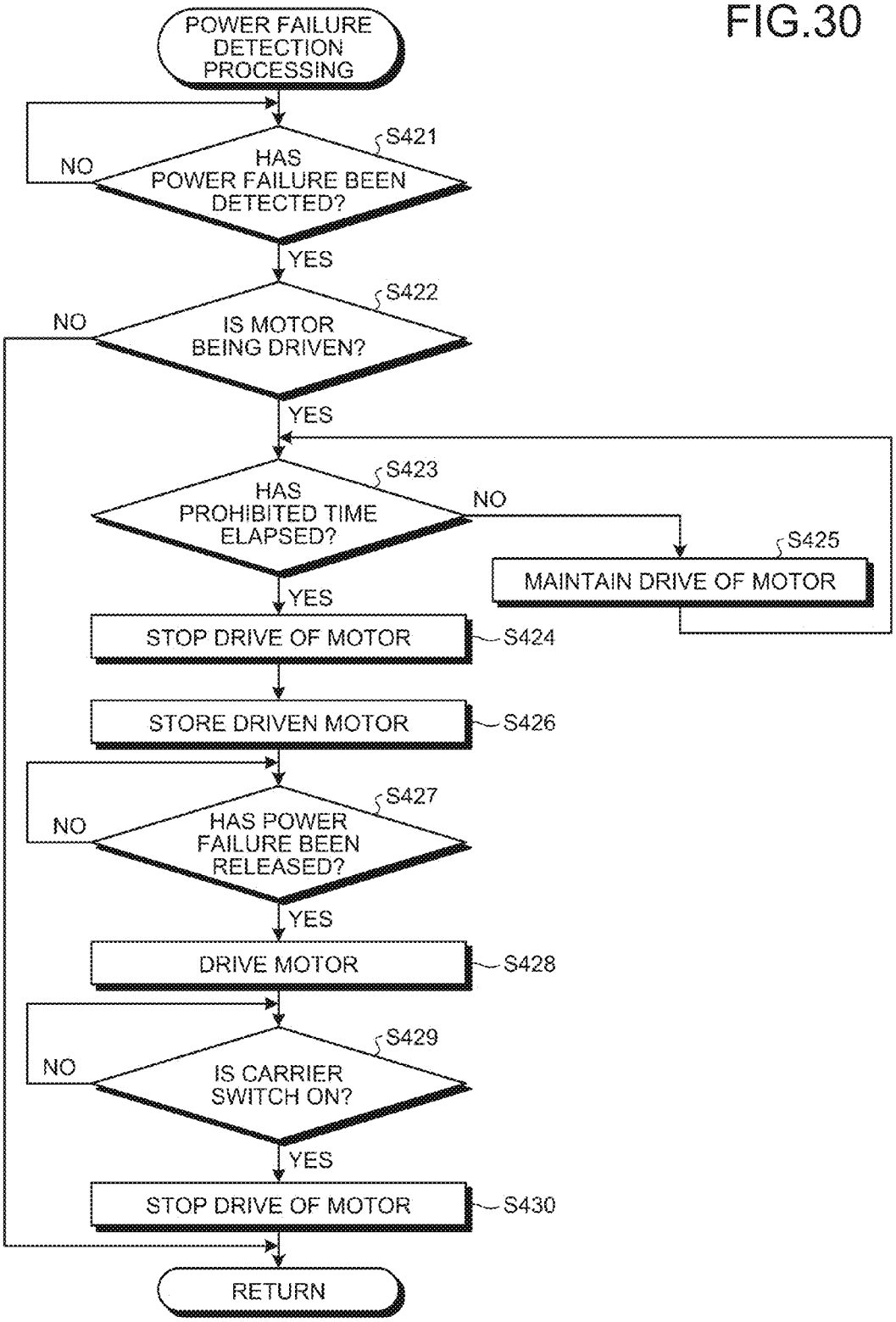
FIG. 30 is a flowchart of the processing details of power failure detection processing that the dispensing controller illustrated in FIG. 20 performs.

FIG. 30 is a flowchart of the processing details of power failure detection processing that the dispensing controller 60 performs.

In this power failure detection processing, the dispensing controller 60, if a signal indicating that a power failure has been detected is input thereto from the frequency detector 49 (Yes at Step S421), determines whether the motor 43 is being driven forward or being driven backward (Step S422).

If the motor 43 is not being driven (No at Step S422), the dispensing controller 60 returns the procedure to end the present processing without performing processing described below.

If the motor 43 is being driven (Yes at Step S422), the dispensing controller 60 determines whether a measured time measured from when the carrier switch 45 was switched from the on state to the off state to the present point in time has elapsed a prohibited time read from the memory 61 (Step S423).

The prohibited time is stored in the memory 61 and relates to a time during which the stopping of the drive of the motor 43 is prohibited after the starting of the drive of the motor 43. This prohibited time is set in order to keep the lower pedals 28 and 28' and the upper pedals 29 and 29' from stopping in the swinging state after the pedal links 35 and 35' have moved upward as described above.

If the measured time has elapsed the prohibited time (Yes at Step S423), the dispensing controller 60 stops the drive of the motor 43 (Step S424). In contrast, if the measured time has not elapsed the prohibited time (No at Step S423), the dispensing controller 60 allows the motor 43 to be driven by inertia and maintains the drive (Step S425), and the process returns to Step S423.

The dispensing controller 60 that has stopped the drive of the motor 43 at Step S424 stores the fact that the motor 43 has been driven in the memory 61 (Step S426) and waits for a signal from the frequency detector 49 (Step S427).

The dispensing controller 60, if a signal indicating that the power failure has been released is input thereto from the frequency detector 49, that is, if the power failure has been released (Yes at Step S427), drives the motor 43 (Step S428), or specifically, drives the motor 43 forward or backward in accordance with the contents stored in the memory 61 and monitors whether the carrier switch 45 is turned to the on state (Step S429). As a result of this monitoring, if the carrier switch 45 is turned to the on state (Yes at Step S429), the dispensing controller 60 stops the drive of the motor 43 (Step S430) and then returns the procedure to end the present power failure detection processing. With this processing, the output gear 443 is positioned at the standby position.

The article dispensing apparatus 20 described above in which the first article discharging apparatus 20*a* includes the motor 43 as the driving source for the first article discharging apparatus 20*a* and the second article discharging apparatus 20*b* and the driving unit 40 that alternatively selects the first article discharging apparatus 20*a* or the second article discharging apparatus 20*b* when a discharging instruction has been given in accordance with the discharging instruction to give the driving force from the motor 43 to the selected article discharging apparatus can reduce the number of driving sources relative to the number of discharging mechanisms and can reduce manufacturing costs. Besides, the first article discharging apparatus 20*a* includes the driving unit 40 including the motor 43, and the first article discharging apparatus 20*a* alone can also be used. In other words, the first article discharging apparatus 20*a* can be used not only for the article storage rack 10 including an even number of article storage passages 13 arranged fore and aft as described above but also for the article storage rack 10 including an odd number of article storage passages 13 arranged fore and aft. Consequently, the article dispensing apparatus 20 can reduce manufacturing costs and can make provisions flexibly in accordance with the number of the article storage passages 13 adjacent to each other fore and aft.

The article dispensing apparatus 20 in which the dispensing controller 60 performs Return Processing (1) and (2) that, when the output gear 443 rotated from the standby position in one direction or another direction does not return to the standby position in a certain time, rotate the output gear 443 in the other direction or the one direction to return the output gear 443 to the standby position can position the output gear 443 at the standby position and prepare for the sales of articles other than an article the sales of which have been suspended. In other words, even when the sales of the article from either the first article discharging apparatus 20*a* or the second article discharging apparatus 20*b* have been suspended, the other can continue discharging the article, whereby careful operation corresponding to each of the article storage passages 13 can be achieved, and losses of sales opportunities can be reduced.

The article dispensing apparatus 20 in which the motor 43 as the driving source is a DC motor is less susceptible to regional voltage and/or frequency fluctuations and can be installed at various locations.

The article dispensing apparatus 20 in which the first out-of-stock detection switch 26 and the second out-of-stock detection switch 27 are installed in the first article discharging apparatus 20*a* can use the first article discharging apparatus 20*a* alone, can also thereby make provisions flexibly in accordance with the number of the article storage passages 13 adjacent to each other fore and aft, and can put the harnesses together in the first article discharging apparatus 20*a*, because the electric parts are arranged only in the first article discharging apparatus 20*a*.

The article dispensing apparatus 20 in which the dispensing controller 60, when the continuous dispensing instruction is given thereto from the vending machine controller 100, drives the motor 43 forward until the on signal is input from the first out-of-stock detection switch 26 and then drives the motor 43 backward until the on signal is input from the second out-of-stock detection switch 27 can all dispense the first articles in the first article storage passage 13*a* and the second articles in the second article storage passage 13*b* continuously. With this processing, when the articles in the first article storage passage 13*a* and the second article storage passage 13*b* are replaced, for example, the continuous dispensing instruction is given from the vending machine controller 100 to the dispensing controller 60 via a remote controller, for example, whereby the articles stored in the first article storage passage 13*a* and the second article storage passage 13*b* can all be dispensed, whereby working efficiency in article replacement working and the like can be improved.

The article dispensing apparatus 20 in which the dispensing controller 60, when the standby return instruction is given thereto from the vending machine controller 100, drives the motor 43 to position the output gear 443 at the standby position, even when the output gear 443 slightly rotates from the standby position to separate from the standby position during transportation of a vending machine in which the article dispensing apparatus 20 is used, gives the standby return instruction to the dispensing controller 60 from the vending machine controller 100 via remote controller, for example, when the vending machine is installed, whereby working efficiency in initial setting working can be improved by positioning all the output gears 443 at the standby position.

The article dispensing apparatus 20 in which the dispensing controller 60, when a point in time when the frequency detector 49 detects a power failure is within the preset prohibited time, allows the motor 43 to be driven by inertia to maintain the drive of the motor 43 can keep the lower pedals 28 and 28' and the upper pedals 29 and 29' from stopping in the swinging state after the pedal links 35 and 35' have moved upward and can thereby prevent a plurality of articles from being dispensed from the article storage passages 13*a* and 13*b*.

The article dispensing apparatus 20 in which the dispensing controller 60, when the frequency detector 49 detects a power failure after the lapse of the prohibited time, once stops the drive of the motor 43 and then drives the motor 43 that has been once stopped to be driven again by detecting the release of the power failure by the frequency detector 49, even when a power failure or the like occurs while the motor 43 is being driven, and the power failure is then released, avoids a state in which an article is not being sold to enable the sales of the article, whereby losses of sales opportunities can be reduced.

Although a preferred embodiment of the disclosure has been described, the disclosure is not limited to this embodiment, and various alterations can be made.

Although the first article discharging apparatus 20*a* corresponds to the first article storage passage 13*a*, and the second article discharging apparatus 20*b* corresponds to the second article storage passage 13*b* in the above embodiment, the disclosure is not limited to this embodiment; one article dispensing apparatus may correspond to the other article storage passage, and the other article dispensing apparatus may correspond to the one article storage passage.

According to some embodiments, one article dispensing apparatus includes the driving source for the one article discharging apparatus and the other article discharging apparatus and a driving force giving unit that alternatively selects the one article discharging apparatus or the other article discharging apparatus in accordance with a discharging instruction to give the driving force from the driving source to the selected article discharging apparatus when the discharging instruction has been given. Thus, some embodiments can reduce the number of driving sources relative to the number of the article discharging apparatuses and can reduce manufacturing costs. Besides, the one article discharging apparatus includes the driving source and the driving force giving unit, and the one article discharging apparatus alone can also be used. In other words, the one article discharging apparatus can be used not only for an article storage apparatus including an even number of article storage passages arranged fore and aft but also for an article storage apparatus including an odd number of article storage passages arranged fore and aft. Consequently, some embodiments produce the effect of making it possible to reduce manufacturing costs and to make provisions flexibly in accordance with the number of the article storage passages adjacent to each other fore and aft.

According to some embodiments, the controller prohibits the stopping of the drive of the driving source even when the supply of electric power to the driving source is interrupted until a preset prohibited time elapses from the starting of rotation to allow the rotation of the output gear when the output gear is rotated from the standby position by the discharging instruction. Thus, some embodiments produce the effect of making it possible to prevent a plurality of articles from being dispensed from the article discharging apparatuses.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An article dispensing apparatus comprising:

one article discharging apparatus arranged in one article storage passage configured to store therein charged articles in an up-and-down direction, the one article discharging apparatus being configured to prevent the articles stored in the one article storage passage from moving downward in a discharge standby state, and when being driven, discharge a lowermost article stored in the one article storage passage downward;

another article discharging apparatus arranged in another article storage passage that is adjacent to the one article storage passage and-configured to store therein charged articles in the up-and-down direction, the another article discharging apparatus being combined back-to-back with the one article discharging apparatus and configured to prevent the articles stored in the another article storage passage from moving downward in a discharge standby state, and when being driven, discharge a lowermost article stored in the another article storage passage downward;

one driving source for the one article discharging apparatus and the another article discharging apparatus;

one output gear arranged rotatably forward and backward about a central axis of the one output gear, the one output gear being configured to rotate in one direction by a driving force from the one driving source from a preset standby position when a discharging instruction has been given to the one article discharging apparatus, and rotate in another direction from the standby position by the driving force from the one driving source when a discharging instruction has been given to the another article discharging apparatus;

two link levers where each link lever is provided rotatably about an axis of each link lever corresponding to each article discharging apparatus, and is configured to put the corresponding article discharging apparatus into the discharge standby state, and drive the corresponding article discharging apparatus when a driving force is given to the link lever by a rotation of the one output gear and the link lever is rotated by the driving force; and a controller configured to, when the one output gear is rotated from the standby position by the discharging instruction, prohibit stopping of drive of the one driving source to allow the rotation of the one output gear until a preset prohibited time elapses from starting of the rotation of the one output gear even when a supply of electric power to the one driving source is interrupted, wherein when the one driving source is driven forward, the one output gear rotates in the one direction to rotate one of the two link levers causing the one article discharging apparatus to discharge the lowermost article stored in the one article storage passage, and when the one driving source is driven backward, the one output gear rotates in the another direction to rotate the other of the two link levers causing the another article discharging apparatus to discharge the lowermost article stored in the another article storage passage.

2. The article dispensing apparatus according to claim 1, wherein the one driving source is common to the one article discharging apparatus and the another article discharging apparatus.

3. The article dispensing apparatus according to claim 1, wherein the one driving source is a direct-current motor.

4. The article dispensing apparatus according to claim 2, wherein the one driving source is a direct-current motor.

5. The article dispensing apparatus according to claim 1, wherein the one article discharging apparatus includes a first pedal configured to advance into the one article storage passage to prevent the articles stored in the one article storage passage from moving downward in the discharge standby state, and to retract to discharge the lowermost article stored in the one article storage passage downward when being driven, and the another article discharging apparatus includes a second pedal configured to advance into the another article storage passage to prevent the articles stored in the another article storage passage from moving downward in the discharge standby state, and to retract to discharge the lowermost article stored in the another article storage passage downward when being driven.

6. The article dispensing apparatus according to claim 5, wherein the one article discharging apparatus further includes a first pedal link connecting the first pedal to the one of the two link levers and arranged movably so that when the one output gear rotates in the one direction to rotate the one of the two link levers, the first pedal link moves to cause the first pedal to retract and discharge the lowermost article in the one article storage passage, and the another article discharging apparatus further includes a second pedal link connecting the second pedal to the other of the two link levers and arranged movably so that when the one output gear rotates in the another direction to rotate the other of the two link levers, the second pedal link moves to cause the second pedal to retract and discharge the lowermost article in the another article storage passage.

7. The article dispensing apparatus according to claim 6, wherein the one output gear includes a cam part protruding from one surface of the one output gear, the one output gear being configured so that when the one output gear rotates in the one direction, the cam part abuts against the one of the two link levers causing the one article discharging apparatus to discharge the lowermost article stored in the one article storage passage, and when the one output gear rotates in the another direction, the cam part abuts against the other of the two link levers causing the another article discharging apparatus to discharge the lowermost article stored in the another article storage passage.

8. The article dispensing apparatus according to claim 7, further comprising:

a carrier switch arranged adjacent to the one output gear and configured to switch between an on-state and an off-state, wherein the one output gear further includes a pressing piece protruding from another surface of the one output gear opposite to the one surface to press against the carrier switch, so that when the one output gear is in the standby position, the carrier switch is in the on-state in which the pressing piece presses the carrier switch, and when the one output gear rotates from the standby position, the carrier switch switches to the off-state in which the pressing piece does not press the carrier switch, and the controller determines the discharge of the lowermost article stored in the one or another article storage passage when the one output gear rotates from the standby position and the carrier switch switches to the on-state within the preset prohibited time.

* * * * *